US012365961B2

(12) United States Patent
Endoh et al.

(10) Patent No.: US 12,365,961 B2
(45) Date of Patent: Jul. 22, 2025

(54) HIGH STRENGTH STEEL SHEET AND METHOD FOR MANUFACTURING THE SAME

(71) Applicant: JFE STEEL CORPORATION, Tokyo (JP)

(72) Inventors: Kazuki Endoh, Tokyo (JP); Yoshiyasu Kawasaki, Tokyo (JP); Yuki Toji, Tokyo (JP); Yoshimasa Funakawa, Tokyo (JP); Mai Aoyama, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 969 days.

(21) Appl. No.: 17/433,875

(22) PCT Filed: Dec. 10, 2019

(86) PCT No.: PCT/JP2019/048186

§ 371 (c)(1),
(2) Date: Feb. 7, 2022

(87) PCT Pub. No.: WO2020/174805

PCT Pub. Date: Sep. 3, 2020

(65) Prior Publication Data

US 2022/0186334 A1 Jun. 16, 2022

(30) Foreign Application Priority Data

Feb. 25, 2019 (JP) ..... 2019-031168

(51) Int. Cl.

| | |
|---|---|
| ***C21D 9/46*** | (2006.01) |
| ***B21C 47/02*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/02*** | (2006.01) |
| ***C23C 2/28*** | (2006.01) |
| ***C23C 2/40*** | (2006.01) |

(52) U.S. Cl.

CPC ..... *C21D 9/46* (2013.01); *B21C 47/02* (2013.01); *C21D 8/0226* (2013.01); *C21D 8/0236* (2013.01); *C22C 38/001* (2013.01); *C22C 38/002* (2013.01); *C22C 38/02* (2013.01); *C22C 38/04* (2013.01); *C22C 38/06* (2013.01); *C23C 2/02* (2013.01); *C23C 2/0224* (2022.08); *C23C 2/024* (2022.08); *C23C 2/28* (2013.01); *C23C 2/40* (2013.01); *C21D 2211/001* (2013.01); *C21D 2211/005* (2013.01); *C21D 2211/008* (2013.01)

(58) Field of Classification Search

CPC ..... C21D 2211/001; C21D 2211/005; C21D 2211/008; C22C 38/04

See application file for complete search history.

(56) References Cited

U.S. PATENT DOCUMENTS

| | | | |
|---|---|---|---|
| 2017/0204490 A1 | 7/2017 | Kawasaki et al. | |
| 2017/0298482 A1* | 10/2017 | Kawasaki | C22C 38/12 |
| 2017/0306435 A1 | 10/2017 | Kawasaki et al. | |
| 2018/0057916 A1 | 3/2018 | Obata et al. | |

FOREIGN PATENT DOCUMENTS

| | | |
|---|---|---|
| CN | 106574340 A | 4/2017 |
| CN | 107075627 A | 8/2017 |
| CN | 107075642 A | 8/2017 |
| CN | 107075643 A | 8/2017 |
| CN | 107075644 A | 8/2017 |
| CN | 107923018 A | 4/2018 |
| CN | 108603269 A | 9/2018 |
| EP | 3 178 956 A1 | 6/2017 |
| EP | 3 178 957 A1 | 6/2017 |
| EP | 3 214 193 A1 | 9/2017 |
| EP | 3 214 196 A1 | 9/2017 |
| EP | 3 214 197 A1 | 9/2017 |
| EP | 3 219 822 A1 | 9/2017 |
| EP | 3 346 019 A1 | 7/2018 |

(Continued)

OTHER PUBLICATIONS

JP2018178247A English language translation (Year: 2018).*

Mar. 10, 2020 International Search Report issued in International Application No. PCT/JP2019/048186.

Mar. 17, 2022 Extended European Search Report issued in European Patent Application No. 19916867.5.

Jun. 26, 2023 Office Action issued in Korean Patent Application No. 10-2021-7026793.

Aug. 3, 2022 Office Action issued in Chinese Patent Application No. 201980092688.1.

(Continued)

*Primary Examiner* — Sally A Merkling

*Assistant Examiner* — Sean P. O'Keefe

(74) *Attorney, Agent, or Firm* — Oliff PLC

(57) ABSTRACT

A high strength steel sheet and method for manufacturing the same. The steel sheet has a specified chemical composition and a specified microstructure. A value calculated by dividing the average Mn content in retained austenite by the average Mn content in ferrite is 1.5 or more, a value calculated by dividing the sum of the area fraction of as-quenched martensite having a circle-equivalent grain size of 3 μm or more and the area fraction of retained austenite having a circle-equivalent grain size of 3 μm or more by the sum of the area fraction of all the as-quenched martensite and the area fraction of all the retained austenite is less than 0.4, and a value calculated by dividing the area fraction of retained austenite grains adjacent to three or more ferrite grains having different crystal orientations by the area fraction of all the retained austenite is less than 0.6.

20 Claims, No Drawings

(56) References Cited

FOREIGN PATENT DOCUMENTS

| | | | |
|---|---|---|---|
| EP | 3 415 653 | A1 | 12/2018 |
| EP | 3 591 087 | A1 | 1/2020 |
| JP | S61-157625 | U | 9/1986 |
| JP | H01-259120 | A | 10/1989 |
| JP | 2003-138345 | A | 5/2003 |
| JP | 6123966 | B1 | 5/2017 |
| JP | 2018-178247 | A | 11/2018 |
| WO | 2016/021193 | A1 | 2/2016 |
| WO | 2016/067623 | A1 | 5/2016 |
| WO | 2016/132680 | A1 | 8/2016 |
| WO | 2018/088421 | A1 | 5/2018 |
| WO | 2019/188640 | A1 | 10/2019 |

OTHER PUBLICATIONS

Dec. 20, 2023 Office Action issued in Korean Patent Application No. 10-2021-7026793.
Feb. 19, 2025 Office Action issued in European Patent Application No. 19 916 867.5.

* cited by examiner

HIGH STRENGTH STEEL SHEET AND METHOD FOR MANUFACTURING THE SAME

TECHNICAL FIELD

This application relates to a high strength steel sheet which can preferably be used as a material for members in industrial fields such as automotive and electrical industrial fields and which is excellent in terms of formability, and relates to a method for manufacturing the steel sheet, and in particular, is intended to obtain a high strength steel sheet which has a TS (tensile strength) of 980 MPa or more and which is excellent not only in terms of ductility but also in terms of hole expansion formability and bendability.

BACKGROUND

Nowadays, from the viewpoint of global environment conservation, an increase in the fuel efficiency of an automobile is an important issue to be addressed. Therefore, there is an active trend toward increasing the strength of a material for an automobile body to decrease the thickness of the material, thereby decreasing the weight of the automobile body. However, since an increase in the strength of a steel sheet causes a deterioration in formability, there is a demand for the development of a material having not only high strength but also high formability.

As a steel sheet which is excellent not only in terms of high strength but also in terms of high ductility, a high strength steel sheet utilizing the strain-induced transformation of retained austenite is proposed. Since such a steel sheet has a steel microstructure including retained austenite, it is possible to easily form the steel sheet due to retained austenite when forming is performed, and it is possible to achieve high strength due to retained austenite transforming into martensite after forming has been performed.

For example, Patent Literature 1 proposes a high strength steel sheet having significantly high ductility which contains Mn in an amount of 0.2 weight % to 2.5 weight %, which has a tensile strength of 1000 MPa or more and an EL (total elongation) of 30% or more, and which utilizes the strain-induced transformation of retained austenite. Such a steel sheet is manufactured by forming austenite in a steel sheet containing C, Si, and Mn as basic composition and by thereafter performing a so-called austempering treatment, in which the steel sheet is subjected to quenching and isothermal holding in a temperature range for bainite transformation. In this austempering treatment, retained austenite is formed due to an increase in the C concentration in austenite, and a large amount of C of more than 0.3% is necessary to form a large amount of retained austenite. However, in the case where the C concentration in steel is high, there is a deterioration in spot weldability, and in particular, there is a marked deterioration in spot weldability in the case where the C concentration is more than 0.33, which results in difficulty in using the steel sheet practically for an automobile. In addition, since the main object of Patent Literature 1 is to improve the ductility of a high strength steel sheet, no consideration is given to hole expansion formability or bendability.

In Patent Literature 2, by performing a heat treatment in a temperature range for forming a ferrite-austenite dual phase on steel containing Mn in an amount of 4 weights to 6 weights, a high level of strength-ductility balance is achieved. However, in the case of Patent Literature 2, since no consideration is given to an improvement in ductility due to an increase in the Mn concentration in untransformed austenite, there is room for an improvement in workability.

In addition, in Patent Literature 3, by performing a heat treatment in a temperature range for forming a ferrite-austenite dual phase on steel containing Mn in an amount of 3.0 mass % to 7.0 mass % to increase the Mn concentration in untransformed austenite, stable retained austenite is formed, thereby improving total elongation. However, since the heat treatment time is short, it is inferred that there is an insufficient increase in the Mn concentration due to the low diffusion rate of Mn.

Moreover, in Patent Literature 4, by performing heat treatment, for a long time, in a temperature range for forming a ferrite-austenite dual phase on a hot rolled steel sheet containing Mn in an amount of 0.50 mass % to 12.00 mass % to increase the Mn concentration in untransformed austenite, retained austenite having a large aspect ratio is formed, which results in an improvement in uniform elongation and hole expansion formability. However, in Patent Literature 4, consideration is given only to an improvement in the ductility and hole expansion formability of a high strength steel sheet, and no consideration is given to an improvement in hole expansion formability or bendability through the control of dispersion conditions in a second phase including retained austenite and martensite.

CITATION LIST

Patent Literature

PTL 1: Japanese Unexamined Patent Application Publication No. 61-157625

PTL 2: Japanese Unexamined Patent Application Publication No. 1-259120

PTL 3: Japanese Unexamined Patent Application Publication No, 2003-138345

PTL 4: Japanese Patent No. 6123966

SUMMARY

Technical Problem

The disclosed embodiments have been completed in view of the situation described above, and an object of the disclosed embodiments is to provide a high strength steel sheet which has a TS (tensile strength) of 980 MPa or more and which is excellent in terms of formability, and in particular, not only in terms of ductility but also in terms of hole expansion formability and bendability and a method for manufacturing the steel sheet.

Solution to Problem

To solve the problems described above, the inventors diligently conducted investigations from the viewpoints of the chemical composition of a steel sheet and a method for manufacturing the steel sheet and, as a result, found the following.

The chemical composition of a steel material is controlled to contain Mn in an amount of 2.50 mass % or more and 8.00 mass % or less with the contents of other alloy elements such as Ti being appropriately controlled as needed, the steel material is subjected to hot rolling, and the hot rolled steel sheet is held in a temperature range equal to or lower than the $Ac_1$ transformation temperature for more than 1800 s as needed, is thereafter subjected to pickling as needed, and is then subjected to cold rolling. Consequently, the steel sheet is held in a temperature range equal to or higher than the $Ac_3$ transformation temperature for 20 s to 1800 s, the steel sheet is cooled to a temperature of 50° C. or higher and 350° C. or lower, the cooled steel sheet is held at the cooling stop temperature for 2 s to 600 s, the steel sheet is cooled, and a pickling treatment is then performed as needed. Subsequently, the steel sheet is held in a temperature range equal to or higher than the $Ac_1$ transformation temperature and equal to or lower than ($Ac_1$ transformation temperature+150° C.) for 20 s to 1800 s, and the steel sheet is cooled, subjected to a pickling treatment as needed, then preferably held in a temperature range equal to or higher than the $Ac_1$ transformation temperature and equal to or lower than ($Ac_1$ transformation temperature+150° C.) for 20 s to 1800 s, and then cooled. As a result, it was found that it is possible to manufacture a high strength steel sheet excellent in terms of formability having a steel microstructure including, in terms of area fraction, 35% or more and 80% or less of ferrite, 5% or more and 35% or less of as as-quenched martensite, 0.1% or more and less than 3.0% of tempered martensite, and 8% or more of retained austenite, in which the average grain size of the ferrite is 6 μm or less, in which the average grain size of the retained austenite is 3 μm or less, in which a value calculated by dividing the average Mn content (mass %) in the retained austenite by the average Mn content (mass %) in the ferrite is 1.5 or more, in which a value calculated by dividing the sum of the area fraction of as-quenched martensite having a circle-equivalent grain size of 3 μm or more and the area fraction of retained austenite having a circle-equivalent grain size of 3 μm or more by the sum of the area fraction of all the as-quenched martensite and the area fraction of all the retained austenite is less than 0.4, and in which a value calculated by dividing the area fraction of retained austenite grains adjacent to three or more ferrite grains having different crystal orientations by the area fraction of all the retained austenite is less than 0.6.

The disclosed embodiments have been completed on the basis of the knowledge described above, and the subject matter of the disclosed embodiments is as follows.

[1] A high strength steel sheet having a chemical composition containing, by mass %, C: 0.030% to 0.250%, Si: 0.01% to 3.00%, Mn: 2.50% to 8.00%, P: 0.001% to 0.100%, S: 0.0001% to 0.0200%, N: 0.0005% to 0.0100%, Al: 0.001% to 2.000%, and a balance being Fe and incidental impurities and, a steel microstructure including, in terms of area fraction, 35% or more and 80% or less of ferrite, 5% or more and 35% or less of as-quenched martensite, 0.1% or more and less than 3.0% of tempered martensite, and 8% or more of retained austenite, in which an average grain size of the ferrite is 6 qua or less, in which an average grain size of the retained austenite is 3 μm or less, in which a value calculated by dividing an average Mn content (mass %) in the retained austenite by an average Mn content (mass %) in the ferrite is 1.5 or more, in which a value calculated by dividing a sum of an area fraction of as-quenched martensite having a circle-equivalent grain size of 3 μm or more and an area fraction of retained austenite having a circle-equivalent grain size of 3 μm or more by a sum of an area fraction of all the as-quenched martensite and an area fraction of all the retained austenite is less than 0.4, and in which a value calculated by dividing an area fraction of retained austenite grains adjacent to three or more ferrite grains having different crystal orientations by the area fraction of all the retained austenite is less than 0.6.

[2] The high strength steel sheet according to item [1], in which the chemical composition further contains, by mass %, at least one selected from Ti: 0.005% to 0.200%, Nb: 0.005% to 0.200%, V: 0.005% to 0.500%, W: 0.005% to 0.500%, B: 0.0003% to 0.0050%, Ni: 0.005% to 1.000%, Cr: 0.005% to 1.000%, Mo: 0.005% to 1.000%, Cu: 0.005% to 1.000%, Sn: 0.002% to 0.200%, Sb: 0.002% to 0.200%, Ta: 0.001% to 0.100%, Ca: 0.0005% to 0.0050%, Mg: 0.0005% to 0.0050%, Zr: 0.0005% to 0.0050%, and REM: 0.0005% to 0.0050%.

[3] The high strength steel sheet according to item [1] or [2], in which the steel sheet has a galvanizing layer on a surface of the steel sheet.

[4] The high strength steel sheet according to item [3], in which the galvanizing layer is a galvannealing layer.

[5] A method for manufacturing a high strength steel sheet, the method including heating a steel slab having the chemical composition according to item [1] or [2], performing hot rolling on the heated slab with a finish rolling delivery temperature of 750° C. or higher and 1000° C. or lower, coiling the hot rolled steel sheet at a temperature of 300° C. or higher and 750° C. or lower, performing cold rolling on the hot rolled steel sheet, subsequently holding the cold rolled steel sheet in a temperature range equal to or higher than an $Ac_3$ transformation temperature for 20 s to 1800 s, cooling the steel sheet to a cooling stop temperature of 50° C. or higher and 350° C. or lower, holding the cooled steel sheet at the cooling stop temperature for 2 s to 600 s, cooling the steel Sheet, subsequently holding the cooled steel sheet in a temperature range equal to or higher than an $Ac_1$ transformation temperature and equal to or lower than ($Ac_1$ transformation temperature+150° C.) for 20 s to 1800 s, and cooling the steel sheet.

[6] A method for manufacturing a high strength steel sheet, the method including heating a steel slab having the chemical composition according to item [1] or [2], performing hot rolling on the heated slab with a finish rolling delivery temperature of 750° C. or higher and 1000° C. or lower, coiling the hot rolled steel sheet at a temperature of 300° C. or higher and 750° C. or lower, performing cold rolling on the hot rolled steel sheet, subsequently holding the cold rolled steel sheet in a temperature range equal to or higher than an $Ac_3$ transformation temperature for 20 s to 1800 s, cooling the steel sheet to a cooling stop temperature of 50° C. or higher and 350° C. or lower, holding the cooled steel sheet at the cooling stop temperature for 2 s to 600 s, cooling the steel sheet, subsequently holding the cooled steel sheet in a temperature range equal to or higher than an $Ac_1$ transformation temperature and equal to or lower than ($Ac_1$ transformation temperature+150° C.) for 20 s to 1800 s, cooling the steel sheet, again holding the cooled steel sheet in the temperature range equal to or higher than the $Ac_1$ transformation temperature and equal to or lower than ($Ac_1$ transformation temperature+150"° C.) for 20 s to 1800 s, and cooling the steel sheet.

[7] The method for manufacturing a high strength steel sheet according to item [5] or [6], the method further including, after coiling has been performed, holding the steel sheet in a temperature range equal to or lower than the Act transformation temperature for more than 1800 s.

[8] The method for manufacturing a high strength steel sheet according to any one of items [5] to [7], the method further including performing a galvanizing treatment.

[9] The method for manufacturing a high strength steel Sheet according to item [8], the method further including, after the galvanizing treatment has been performed, performing an alloying treatment at a temperature of 450° C. to 600° C.

Advantageous Effects

According to the disclosed embodiments, it is possible to obtain a high strength steel sheet which has a TS (tensile strength) of 980 MPa or more and which is excellent in terms of formability, and in particular, not only in terms of ductility but also in terms of hole expansion formability and bendability. By using a high strength steel sheet manufactured by using the manufacturing method according to the disclosed embodiments for, for example, automobile structural members, it is possible to improve fuel efficiency due to a decrease in the weight of an automobile body, which has a significant utility value in the industry.

DETAILED DESCRIPTION

Hereafter, the disclosed embodiments will be specifically described. Here, "%" used when describing the contents of the composition of a chemical composition denotes "mass %", unless otherwise noted.

(1) The reasons why the chemical composition of steel is specified as described above in the disclosed embodiments will be described.

C: 0.030% or More and 0.250% or Less

C is an element which is necessary to increase strength by forming martensite. In addition, C is an element which is effective for improving the ductility of steel by improving the stability of retained austenite. In the case where the C content is less than 0.030%, since it is difficult to achieve the desired area fraction of martensite, it is not possible to achieve the desired strength. In addition, since it is difficult to achieve a sufficient area fraction of retained austenite, it is not possible to achieve good ductility. On the other hand, in the case where the C content is excessive and is more than 0.250%, since there is an excessive increase in the area fraction of hard martensite, there is an increase in the number of micro voids at the crystal grain boundaries of martensite and crack propagation progresses when a hole expanding test is performed, which results in a deterioration in hole expansion formability. In addition, since there is a deterioration in the mechanical properties of a weld zone due to a significant increase in the hardness of the weld zone and a heat-affected zone (HAZ), there is a deterioration in spot weldability, arc weldability, and so forth. From such viewpoints, the C content is set to be 0.030% or more and 0.250% or less. It is preferable that the C content be 0.080% or more. It is preferable that the C content be 0.200% or less. Hereafter, the term "hard martensite" denotes as-quenched martensite (martensite as-quenched state).

Si: 0.01% or More and 3.00% or Less

Since Si improves the work hardenability of ferrite, Si is effective for achieving good ductility. Since there is a decrease in the effect of Si included in the case where the Si content is less than 0.01%, the lower limit of the Si content is set to be 0.01%. However, in the case where the Si content is excessive and is more than 3.00%, embrittlement occurs in steel, and there is a deterioration in surface quality due to, for example, the occurrence of red scale. Moreover, there is a deterioration in phosphatability and quality of coating. Therefore, the Si content is set to be 0.01% or more and 3.00% or less. It is preferable that the Si content be 0.20% or more. It is preferable that the Si content be 2.00% or less or more preferably less than 0.70%.

Mn: 2.50% or More and 8.00% or Less

Mn is a significantly important composition element in the disclosed embodiments. Mn is an element which stabilizes retained austenite, which is effective for achieving good ductility, and which increases the strength of steel through solid solution strengthening. Such effects are realized in the case where the Mn content in steel is 2.50% or more. However, in the case where the Mn content is excessive and is more than 8.00%, there is a deterioration in phosphatability and quality of coating. From such viewpoints, the Mn content is set to be 2.50% or more and 8.00% or less. It is preferable that the Mn content be 3.10% or more or more preferably 3.20% or more. It is preferable that the Mn content be 6.00% or less or more preferably 4.20% or less.

P: 0.001% or More and 0.100% or Less

P is an element which has the function of solid solution strengthening and which may be included in accordance with desired strength. In addition, P is an element which is effective for forming a multi-phase structure by promoting ferrite transformation. To realize such effects, it is necessary that the P content be 0.001% or more. On the other hand, in the case where the P content is more than 0.100%, there is a deterioration in weldability, and there is a deterioration in galvanizing layer quality due to a decrease in alloying rate when a galvanizing layer is subjected to an alloying treatment. Therefore, the P content is set to be 0.001% or more and 0.100% or less. It is preferable that the P content be 0.005% or more. It is preferable that the P content be 0.050% or less.

S: 0.0001% or More and 0.0200% or Less

S causes embrittlement to occur in steel when hot work is performed as a result of being segregated at grain boundaries and causes a deterioration in local deformability as a result of existing in the form of sulfides. Therefore, it is necessary that the S content be 0.0200% or less, preferably 0.0100% or less, or more preferably 0.0050% or less. However, due to constraints regarding manufacturing techniques, it is necessary that the S content be 0.0001% or more. Therefore, the S content is set to be 0.0001% or more and 0.0200% or less. It is preferable that the S content be 0.0001% or more. It is preferable that the S content be 0.0100% or less or more preferably 0.0050% or less.

N: 0.0005% or More and 0.0100% or Less

N is an element which causes a deterioration in the aging resistance of steel. In particular, in the case where the N content is more than 0.0100%, there is a marked deterioration in aging resistance. Although it is preferable that the N content be as small as possible, it is necessary that the N content be 0.0005% or more due to constraints regarding manufacturing techniques. Therefore, the N content is set to be 0.0005% or more and 0.0100% or less. It is preferable that the N content be 0.0010% or more. It is preferable that the N content be 0.0070% or less.

Al: 0.001% or More and 2.000% or Less

Al is an element which is effective for decreasing the annealing-temperature dependency of mechanical properties, that is, for stabilizing material properties by expanding a temperature range for forming a ferrite-austenite dual phase. Since there is a decrease in the effect of Al included in the case where the Al content is less than 0.001%, the lower limit of the Al content is set to be 0.001%. In addition, since Al is an element which is effective for increasing the cleanliness of steel by functioning as a deoxidizing agent, it is preferable that Al be included in a deoxidizing process. However, in the case where the Al content is more than 2.000%, since there is an increased risk of a crack occurring in a steel slab when continuous casting is performed, there is a deterioration in manufacturability. From such viewpoints, the Al content is set to be 0.001% or more and 2.000% or less. It is preferable that the Al content be 0.200% or more. It is preferable that the Al Content be 1.200% or less.

In addition, by mass %, at least one selected from Ti: 0.005% or more and 0.200% or less, Nb: 0.005% or more and 0.200% or less, V: 0.005% or more and 0.500% or less, W: 0.005% or more and 0.500% or less, B: 0.0003% or more and 0.0050% or less, Ni: 0.005% or more and 1.000% or less, Cr: 0.005% or more and 1,000% or less, Mo: 0.005% or more and 1.000% or less, Cu: 0.005% or more and 1.000% or less, Sn: 0.002% or more and 0.200% or less, Sb: 0.002% or more and 0.200% or less, Ta: 0.001% or more and 0.100% or less, Ca: 0.0005% or more and 0.0050% or less, Mg: 0.0005% or more and 0.0050% or less, Zr: 0.0005% or more and 0.0050% or less, and REM (abbreviation for rare earth metal): 0.0005% or more and 0.0050% or less may optionally be included in addition to the composition described above, Compositions other than those described above are Fe and incidental impurities. Here, in the case where one of the compositions described above is contained in an amount less than the lower limit of the content thereof, such a composition is regarded as being contained as an incidental impurity.

Ti: 0.005% or More and 0.200% or Less

Since Ti is effective for increasing the strength of steel through precipitation strengthening, Ti decreases the difference in hardness between ferrite and a hard second phase (martensite or retained austenite) by increasing the strength of ferrite, thereby making it possible to achieve good hole expansion formability. It is possible to realize such an effect in the case where the Ti content is 0.005% or more. However, in the case where the Ti content is more than 0.200%, since there is an excessive increase in the area fraction of hard martensite, there is an increase in the number of micro voids at the crystal grain boundaries of martensite and crack propagation progresses when a hole expanding test is performed, which may result in a deterioration in hole expansion formability (for blanking), Therefore, in the case where Ti is included, the Ti content is set to be 0.005% or more and 0.200% or less. It is preferable that the Ti content be 0.010% or more. It is preferable that the Ti content be 0.100% or less.

Nb: 0.005% or More and 0.200% or Less, V: 0.005% or More and 0.500% or Less, and W: 0.005% or More and 0.500% or Less Nb, V, and W are effective for increasing the strength of steel through precipitation strengthening, and it is possible to realize such an effect in the case where the content of each of these elements is 0.005% or more. In addition, as in the case of the effect of Ti being contained, these elements decrease the difference in hardness between ferrite and a hard second phase (martensite or retained austenite) by increasing the strength of ferrite, thereby making it possible to achieve good hole expansion formability. It is possible to realize such an effect in the case where the content of each of these elements is 0.005% or more. However, in the case where the Nb content is more than 0.200% or the V content or the W content is more than 0.500%, since there is an excessive increase in the area fraction of hard martensite, there is an increase in the number of micro voids at the crystal grain boundaries of martensite and crack propagation progresses when a hole expanding test is performed, which may result in a deterioration in hole expansion formability. Therefore, in the case where Nb is included, the Nb content is set to be 0.005% or more and 0.200% or less. It is preferable that the Nb content be 0.010% or more. It is preferable that the Nb content be 0.100% or less. In the case where V or w is contained, the content of V or W is set to be 0.005% or more and 0.500% or less. It is preferable that the content of V or W be 0.010% or more. It is preferable that the content of V or W be 0.300% or less.

B: 0.0003% or More and 0.0050% or Less

Since B has the function of inhibiting the formation and growth of ferrite from austenite grain boundaries, B decreases the difference in hardness between ferrite and a hard second phase (martensite or retained austenite) by increasing the strength of ferrite, thereby making it possible to achieve good hole expansion formability. It is possible to realize such an effect in the case where the B content is 0.0003% or more. However, in the case where the B content is more than 0.0050%, there may be a deterioration in formability. Therefore, in the case where B is contained, the B content is set to be 0.0003% or more and 0.0050% or less. It is preferable that the B content be 0.0005% of more. It is preferable that the B content be 0.0030% or less.

Ni: 0.005% or More and 1.000% or Less

Ni is an element which stabilizes retained austenite, which is effective for achieving good ductility, and which increases the strength of steel through solid solution strengthening. It is possible to realize such an effect in the case where the Ni content is 0.005% or more. On the other hand, in the case where the Ni content is more than 1.000%, since there is an excessive increase in the area fraction of hard martensite, there is an increase in the number of micro voids at the crystal grain boundaries of martensite and also crack propagation progresses when a hole expanding test is performed, which may result in a deterioration in hole expansion formability. Therefore, in the case where Ni is contained, the Ni content is set to be 0.005% or more and 1.000% or less. It is preferable that the Ni content be 0.010% or more. It is preferable that the Ni content be 0.500% or less.

Cr: 0.005% or More and 1.000% or Less and Mo: 0.005% or More and 1,000% or Less

Since Cr and Mo have the function of improving a strength-ductility balance, these elements may be included as needed. It is possible to realize such an effect in the case where the Cr content is 0.005% or more or the Mo content is 0.005% or more. However, in the case where the Cr content is excessive and is more than 1,000% or the Mo content is excessive and is more than 1.000%, since there is an excessive increase in the area fraction of hard martensite, there is an increase in the number of micro voids at the crystal grain boundaries of martensite and also crack propagation progresses when a hole expanding test is performed, which may result in a deterioration in hole expansion formability. Therefore, in the case where these elements are included, the Cr content is set to be 0.005% or more and 1.000% or less, and the Mo content is set to be 0.005% or more and 1.000% or less. It is preferable that the Cr content be 0.010% or more. It is preferable that the Cr content be 0.500% or less. It is preferable that the Mo content be 0.010% or more. It is preferable that the Mo content be 0.500% or less.

Cu: 0.005% or More and 1.000% or Less

Cu is an element which is effective for increasing the strength of steel. It is possible to realize such an effect in the case where the Cu content is 0.005% or more. On the other hand, in the case where the Cu content is more than 1.000%, since there is an excessive increase in the area fraction of hard martensite, there is an increase in the number of micro voids at the crystal grain boundaries of martensite and also crack propagation progresses when a hole expanding test is performed, which may result in a deterioration in hole expansion formability. Therefore, in the case where Cu is contained, the Cu content is set to be 0.005% or more and 1.000% or less. It is preferable that the Cu content be 0.010% or more. It is preferable that the Cu content be 0.500% or less.

Sn: 0.002% or More and 0.200% or Less and Sb: 0.002% or More and 0.200% or Less

Sn and Sb are included as needed from the viewpoint of Inhibiting decarburization in a region within about several tens of μm of the surface of the steel sheet due to the nitridation and oxidation of a steel sheet surface. In the case where the Sn content is 0.002% or more or the Sb content is 0.002% or more, it is possible to inhibit such nitridation and oxidation, thereby inhibiting a decrease in the area fraction of martensite on the steel sheet surface, which is effective for achieving satisfactory strength and the stability of material properties. On the other hand, in the case where the Sn content or the Sb content is excessive and is more than 0.200%, there is a deterioration in toughness. Therefore, in the case where Sn and Sb are included, the content of each of these elements is set to be 0.002% or more and 0.200% or less. It is preferable that the content of each of Sn and Sb be 0.004% or more. It is preferable that the content of each of these elements be 0.050% or less. Here, "martensite" denotes as-quenched martensite.

Ta: 0.001% or More and 0.100% or Less

Ta, like Ti and Nb, contributes to increasing strength by forming alloy carbides and alloy carbonitrides. In addition, it is considered that, since Ta is partially dissolved in Nb carbides and Nb carbonitrides to form Complex precipitates such as (Nb, Ta) (C, N), Ta markedly inhibits coarsening of precipitates, thereby stabilizing the contribution to increasing strength through precipitation strengthening. Therefore, it is preferable that Ta be contained. Here, it is possible to realize the above-described effect of stabilizing precipitates in the case where the Ta content is 0.001% or more. On the other hand, in the case where the Ta content is excessively high, the effect of stabilizing precipitates becomes saturated, and there is an increase in alloy cost. Therefore, in the case where Ta is included, the Ta content is set to be 0.001% or more and 0.100% or less. It is preferable that the Ta content be 0.005% or more. It is preferable that the Ta content be 0.050% or less.

Ca: 0.0005% or More and 0.0050% or Less, Mg: 0.0005% or More and 0.0050% or Less, Zr: 0.0005% or More and 0.0050% or Less, and REM: 0.0005% or More and 0.0050% or Less Ca, Mg, Zr and REM are elements which are effective for further reducing the negative effect of sulfides on hole expansion formability through the spheroidizing of sulfides. To realize such an effect, it is preferable the content of each of these elements be 0.0005% or more. However, in the case where the content of each of these elements is excessive and is more than 0.0050%, there is an increase in the amount of, for example, inclusions, which results in surface and internal defects. Therefore, in the case where Ca, Mg, Zr, and REM are included, the content of each of these elements is set to be 0.0005% or more and 0.0050% or less. It is preferable that the content of each of Ca, Mg, Zr, and REM be 0.0010% or more. It is preferable that the content of each of Ca, Mg, Zr, and REM be 0.0040% or less.

(2) Hereafter, the microstructure will be described.

Area Ratio of Ferrite: 35% or More and 80% or Less

To achieve satisfactory ductility, it is necessary that the area fraction of ferrite be 35% or more. In addition, to achieve a tensile strength of 980 MPa or more, it is necessary that the area fraction of soft ferrite be 80% or less. Here, the meaning of "ferrite" includes polygonal ferrite, granular ferrite, and acicular ferrite, which are comparatively soft and excellent in terms of ductility. It is preferable that the area fraction of ferrite be 40% or more. It is preferable that the area fraction of ferrite be 75% or less.

Area Fraction of as-Quenched Martensite: 5% or More and 35% or Less

To achieve a TS of 980 MPa or more, it is necessary that the area fraction of as-quenched martensite be 5% or more. In addition, to achieve good ductility, it is necessary that the area fraction of as-quenched martensite be 35% or less. It is preferable that the area fraction of as-quenched martensite be 5% or more. It is preferable that the area fraction of as-quenched martensite be 30% or less.

Area Fraction of Tempered Martensite: 0.1% or More and Less than 3.0%

To achieve good hole expansion formability, it is necessary that the area fraction of tempered martensite be 0.1% or more. In addition, to achieve a TS of 980 MPa or more, it is necessary that the area fraction of tempered martensite be less than 3.0%. It is preferable that the area fraction of tempered martensite be 0.1% or more. It is preferable that the area fraction of tempered martensite be 2.0% or less.

Incidentally, it is possible to derive the area fractions of ferrite, as-quenched martensite, and tempered martensite by polishing a cross section (L-cross section) in the thickness direction parallel to the rolling direction of a steel sheet, by etching the polished cross section with a 3 vol. % nital solution, by observing 10 fields of view at a position located at ¼ of the thickness (position located at a distance of ¼ of the thickness from the steel sheet surface, where the distance is measured in the thickness direction) with a SEM (scanning electron microscope) at a magnification of 2000 times to obtain microstructure images, by analyzing the obtained microstructure images by using Image-Pro produced by Media Cybernetics, Inc. to calculate the area fraction of each of the microstructures (ferrite, martensite, and tempered martensite) in each of the 10 fields of view, and by calculating the average area fraction of each of the microstructures from the area fractions of each of the microstructures in the 10 fields of view. In addition, in the microstructure image described above, ferrite is identified as a gray microstructure (base microstructure), martensite is identified as a white microstructure, and tempered martensite is identified as a white martensite microstructure containing gray substructures.

Area Fraction of Retained Austenite: 8% or More

To achieve satisfactory ductility, it is necessary that the area fraction of retained austenite be 8% or more or preferably 12% or more.

Here, the area fraction of retained austenite is defined as a volume fraction which is derived by polishing a steel sheet to a plane located 0.1 mm from a position located at ¼ of the thickness, by further performing chemical polishing on the polished surface to remove a thickness of 0.1 mm, by determining the integral intensity ratio of the diffraction peak of each of the (200)-plane, (220)-plane, and (311)- plane of fcc (face centered cubic) iron and the (200)-plane, (211)-plane, and (220)-plane of bcc (body centered cubic) iron of the exposed surface by using an X-ray diffractometer with Coka-ray, and by calculating the average value of the obtained 9 integral intensity ratios to derive a volume fraction.

Average Grain Size of Ferrite: 6 μm or Less

A grain refinement of ferrite contributes to an improvement in TS. Therefore, to achieve the desired TS, it is necessary that the average grain size of ferrite be 6 μm or less or preferably 5 μm or less.

Average Grain Size of Retained Austenite: 3 μm or Less

A grain refinement of retained austenite contributes to an improvement in ductility and hole expansion formability. Therefore, to achieve good ductility and hole expansion formability, it is necessary that the average grain size of retained austenite be 3 μm or less or preferably 2.5 μm or less.

Value Calculated by Dividing Average Mn Content (Mass %) in Retained Austenite by Average Mn Content (Mass %) in Ferrite: 1.5 or More The requirement that the value calculated by dividing the average Mn content (mass %) in retained austenite by the average Mn content (mass %) in ferrite be 1.5 or more is a significantly important feature in the disclosed embodiments. To achieve good ductility, it is necessary that the area fraction of stable retained austenite in which Mn is concentrated be high. It is preferable that such a value be 2.0 or more.

It is possible to derive the Mn content in retained austenite by quantifying Mn distribution in each of the phases in the cross section in the rolling direction at a position located at ¼ of the thickness by using an FE-EPMA (field emission-electron probe micro analyzer) and by calculating the average Mn content in randomly selected 30 retained austenite grains and the average Mn content in randomly selected 30 ferrite grains in the measurement field of view.

Value calculated by dividing sum of area fraction of as-quenched martensite having a circle-equivalent grain size of 3 μm or more and area fraction of retained austenite having a circle-equivalent grain size of 3 μm or more by sum of area fraction of all as-quenched martensite and area fraction of all retained austenite: less than 0.4

The requirement that a value calculated by dividing the sum of the area fraction of as-quenched martensite having a circle-equivalent grain size of 3 μm or more and the area fraction of retained austenite having a circle-equivalent grain size of 3 μm or more by the sum of the area fraction of all the as-quenched martensite and the area fraction of all the retained austenite be less than 0.4 is an important feature in the disclosed embodiments. A decrease in the grain sizes of as-quenched martensite and retained austenite contributes to an improvement in hole expansion formability. To achieve good hole expansion formability, while forming sufficient amounts of as-quenched martensite and retained austenite for achieving high strength and high ductility, it is necessary to increase the area fractions of fine as-quenched martensite and retained austenite. It is preferable that such a value be less than 0.3% or more preferably less than 0.2.

Here, the average grain sizes of ferrite, martensite, and retained austenite are derived by determining the area of each of ferrite grains, martensite grains, and retained austenite grains by using Image-Pro described above, by calculating circle-equivalent grain sizes, and by calculating the average circle-equivalent grain size of each of the phases. Martensite and retained austenite are distinguished by using Phase Map of EBSD (electron backscattered diffraction).

Value calculated by dividing area fraction of retained austenite grains adjacent to three or more ferrite grains having different crystal orientations by area fraction of all retained austenite: less than 0.6

The requirement that a value calculated by dividing the area fraction of retained austenite grains adjacent to three or more ferrite grains having different crystal orientations, that is, retained austenite grains existing at the triple points of ferrite grain boundaries, by the area fraction of all the retained austenite be less than 0.6 is an important feature in the disclosed embodiments. A decrease in the number of ferrite grains which are adjacent to retained austenite grains and which have different crystal orientations causes the relax of stress concentration at the time of hole expansion deformation and bending deformation, thereby contributing to an improvement in hole expansion formability and bendability. Therefore, to achieve good hole expansion formability, it is necessary that the area fraction of retained austenite grains adjacent to three or more ferrite grains having different crystal orientations be low. It is preferable that such a value be less than 0.5.

Here, the crystal orientation of ferrite is determined by using Inverse Pole Figure Map of EBSD (electron backscattered diffraction). In addition, the expression "ferrite grains having different crystal orientations" denotes a case where ferrite grains have a misorientation of 1 degree or more in terms of Euler angle obtained by performing EBSD analysis. In addition, retained austenite grains adjacent to three or more ferrite grains having different crystal orientations are identified by using an IPF map obtained by performing EBSD analysis.

In addition, it is preferable that a value calculated by dividing the area fraction of massive austenite by the sum of the area fraction of lath-structured austenite and the area fraction of massive austenite be less than 0.6. In the case where the area fraction of massive austenite is excessively large, there may be a deterioration in the hole expansion formability of steel. Therefore, to achieve better hole expansion formability, it is preferable that a value calculated by dividing the area fraction of massive austenite by the sum of the area fraction of lath-structured austenite and the area fraction of massive austenite be less than 0.6. It is more preferable that a value calculated by dividing the area fraction of massive austenite by the sum of the area fraction of lath-structured austenite and the area fraction of massive austenite be less than 0.4. The term "massive austenite" denotes an austenite grain having an aspect ratio between major and minor axes of less than 2.0, and the term "lath-structured austenite" denotes an austenite grain having an aspect ratio between major and minor axes of 2.0 or more. Here, the aspect ratio of retained austenite is calculated by drawing an ellipse circumscribed around the retained austenite grain by using Photoshop elements 13 and by dividing the major axis of the ellipse by the minor axis of the ellipse.

Even in the case where, in addition to ferrite, as-quenched martensite, tempered martensite, and retained austenite, bainite, pearlite, and carbides such as cementite are included in a total amount of 10% or less in terms of area fraction in the microstructure according to the disclosed embodiments, there is no decrease in the effects of these embodiments.

(3) Hereafter, the manufacturing conditions will be described.

Steel Slab Heating Temperature

Although there is no particular limitation on the heating temperature of a steel slab, it is preferable that the heating temperature be 1100° C. or higher and 1300° C. or lower. Since precipitates existing in the steel slab heating stage exist in the form of precipitates having a large grain size in a finally obtained steel sheet, such precipitates do not contribute to strength, and it is possible to redissolve Ti- and Nb-based precipitates which has been precipitated when casting is performed. Moreover, from the viewpoint of removing blowholes, segregated materials, and so forth in the surface layer of the steel slab to decrease the number of cracks and unevenness on the steel sheet surface and thereby achieving a higher level of smooth steel sheet surface, it is preferable that the steel slab heating temperature be 1100° C. or higher. On the other hand, from the viewpoint of inhibiting an increase in the amount of scale loss due to an increase in the amount of oxidation, it is preferable that the steel slab heating temperature be 1300° C. or lower. It is more preferable that the steel slab heating temperature be 1150° C. or higher. It is more preferable that the steel slab heating temperature be 1250° C. or lower.

Although it is preferable that a steel slab be manufactured by using a continuous casting method from the viewpoint of inhibiting macro segregation, for example, an ingot casting method or a thin-slab casting method may be used. In addition, not only a conventional method, in which, after having manufactured a steel slab, the slab is first cooled to room temperature and then reheated, but also an energy-saving process such as a hot direct rolling process, in which a slab in the hot state is charged into a heating furnace without being cooled to room temperature and then subjected to hot rolling, or a hot charge rolling or hot direct rolling, in which a slab is rolled immediately after heat retention has been performed for a short time may be used without causing any problem. In addition, a steel slab is made into a sheet bar by performing rough rolling under ordinary conditions, and, in the case where a heating temperature is comparatively low, it is preferable that the sheet bar be heated by using, for example, a bar heater before finish rolling is performed from the viewpoint of inhibiting problems from occurring when hot rolling is performed.

Finish Rolling Delivery Temperature of Hot Rolling: 750° C. or Higher and 1000° C. or Lower The steel slab which has been subjected to heating is subjected to hot rolling through a rough rolling process and a finish rolling process so that a hot rolled steel sheet is obtained. At this time, in the case where the delivery temperature is higher than 1000° C., since there is a rapid increase in the amount of oxides (scale) generated, the interface between the base steel and the oxides is damaged, which results in a tendency for the surface quality to be deteriorated after pickling and cold rolling have been performed. In addition, in the case where, for example, hot rolling scale is partially left unremoved after pickling has been performed, there is a negative effect on ductility and hole expansion formability. Moreover, since there is an excessive increase in grain size, there may be a case where a surface defect occurs in a pressed product when forming is performed. On the other hand, in the case where the delivery temperature is lower than 750° C., there is an increase in load on the rolling process due to an increase in rolling load, and there is an increase in rolling reduction ratio under the condition in which austenite is not recrystallized. As a result, since it is not possible to achieve the desired grain size, there is a marked in-plane anisotropy in a final product due to the growth of an abnormal texture, which results in a deterioration not only in the uniformity (stability) in material properties but also in ductility. Therefore, it is necessary that the finish rolling delivery temperature of hot rolling be 750° C. or higher and 1000° C. or lower. It is preferable that the finish rolling delivery temperature of hot rolling be 800° C. or higher. It is preferable that the finish rolling delivery temperature of hot rolling be 950° C. or lower.

Coiling Temperature after Hot Rolling: 300° C. or Higher and 750° C. or Lower

In the case where the coiling temperature after hot rolling has been performed is higher than 750° C., since there is an increase in the grain size of ferrite in the hot rolled steel sheet microstructure, it is difficult to achieve the desired strength of a final annealed steel sheet. On the other hand, in the case where the coiling temperature after hot rolling has been performed is lower than 300° C., since there is an increase in the strength of the hot rolled steel sheet, there is an increase in rolling load in a cold rolling process and there is a deterioration in a steel sheet shape, resulting in a deterioration in productivity. Therefore, it is necessary that the coiling temperature after hot rolling has been performed be 300° C. or higher and 750° C. or lower. It is preferable that the coiling temperature after hot rolling has been performed be 400° C. or higher. It is preferable that the coiling temperature after hot rolling has been performed be 650° C. or lower.

Incidentally, in a hot rolling process, finish rolling may be continuously performed by connecting steel sheets which have been subjected to rough rolling. In addition, the steel sheet which has been subjected to rough rolling may be coiled. In addition, to decrease a rolling load when hot rolling is performed, lubrication rolling may be performed in part or all of the finish rolling. It is also preferable that lubrication rolling be performed from the viewpoint of uniform shape and uniform material properties of a steel sheet. Here, in the case where lubrication rolling is performed, it is preferable that the friction coefficient be 0.10 or more and 0.25 or less.

Thus obtained hot rolled steel sheet is optionally subjected to pickling. It is preferable that pickling be performed, because this makes it possible to remove oxides from the steel sheet surface, which results in an improvement in phosphatability and quality of coating. In the case where a hot rolled steel sheet is heated and held, to remove oxides on the steel sheet surface, pickling may be performed once after heating and holding followed by cooling have been performed, or the pickling process may be divided into multiple times. In the case where the pickling process is divided into multiple times, it is preferable that pickling be performed after heating and holding followed by cooling have been performed, because this makes it possible to more effectively remove oxides on the steel sheet surface. In the case where heating and holding is performed plural times, pickling may be performed each time after heating and holding followed by cooling have been performed.

Holding in a temperature range equal to or lower than the $Ac_1$ transformation temperature for more than 1800 s It is preferable that a hot rolled steel sheet be held in a temperature range equal to or lower than the $Ac_1$ transformation temperature for more than 1800 s, because this softens the steel sheet which is to be subjected to a subsequent cold rolling process.

In the case where the steel sheet is held in a temperature range equal to or lower than the Act transformation temperature, since Mn is concentrated in austenite, hard martensite and retained austenite are formed after cooling has been performed. As a result, it is possible to realize a preferable condition in which a value calculated by dividing the sum of the area fraction of as-quenched martensite having a circle-equivalent grain size of 3 μm or more and the area fraction of retained austenite having a circle-equivalent grain size of 3 μm or more by the sum of the area fraction of all the as-quenched martensite and the area fraction of all the retained austenite is less than 0.30. In addition, in the case where holding is performed for less than 1800 s, since it is not possible to remove strain due to hot rolling, there may be a case where the steel sheet is not softened.

Incidentally, as a heat treatment method, any one of a continuous annealing method and a batch annealing method may be used. In addition, when cooling is performed to room temperature after the heat treatment has been performed, there is no particular limitation on the method or cooling rate used for cooling, any one of furnace cooling and air cooling in batch annealing, gas jet cooling, mist cooling, and water cooling in continuous annealing, and so forth may be performed. In addition, when a pickling treatment is performed, a common method may be used.

Cold Rolling

The obtained steel sheet is subjected to cold rolling. Although there is no particular limitation on the cold rolling reduction ratio, it is preferable that the cold rolling reduction ratio be 15% to 80%. By performing cold rolling with a cold rolling reduction ratio in such a range, since it is possible to achieve a sufficiently recrystallized desired microstructure, there is an improvement in ductility.

Holding in Temperature Range Equal to or Higher than $Ac_3$ Transformation Temperature for 20 s to 1800 s In the case where the steel sheet is held in a temperature range lower than the $Ac_1$ transformation temperature or for less than 20 s, since recrystallization does not sufficiently progress, it is not possible to achieve the desired microstructure, which results in a deterioration in λ (blanking) and bendability. In addition, the surface concentration of Mn does not sufficiently progress for achieving quality of coating in subsequent processes. On the other hand, in the case where holding is performed for more than 1800 s, the effect due to surface concentration of Mn becomes saturated.

Cooling to cooling stop temperature of 50° C. or higher and 350° C. or lower and holding at cooling stop temperature for 2 s to 600 s The technological thought of the disclosed embodiments is characterized in that, by forming thin film-structured austenite (nucleation site of austenite which is less likely to come into contact with ferrite) in a microstructure before annealing is performed, such film-structured austenite is made into lath-structured austenite (austenite which is less likely to come into contact with ferrite) in the subsequent annealing process, and Mn is concentrated in such lath-structured austenite. By cooling the steel sheet to a cooling stop temperature of 50° C. or higher and 350° C. or lower and by holding the steel sheet at the cooling stop temperature, film-structured austenite, which is made into lath-structured austenite in the subsequent annealing process, is formed. In the case where holding is performed at a temperature of lower than 50° C., since martensite transformation is completed, there is no film-structured austenite left, which results in lath-structured austenite not being achieved. In addition, in the case where holding is performed at a temperature of higher than 350° C., film-structured austenite is decomposed, which results in lath-structured austenite not being achieved. Therefore, in the case where holding is performed at a temperature of lower than 50° C. or higher than 350° C., since it is not possible to achieve retained austenite, which is less likely to come into contact with ferrite, a large number of retained austenite grains having three or more different crystal orientations are formed at grain boundaries and the triple points of grain boundaries in the subsequent annealing process. As a result, since there is an increase in the number of retained austenite grains which are likely to come into contact with three or more ferrite grains having different crystal orientations in relation to the number of retained austenite grains which are less likely to come into contact with the above-described three or more ferrite grains having different crystal orientations, it is not possible to achieve the desired microstructure. In addition, also in the case where holding is performed for less than 2 s, since it is not possible to achieve retained austenite which is less likely to come into contact with ferrite, it is not possible to achieve the desired microstructure. Moreover, also in the case where holding is performed for more than 600 s, since retained austenite which is less likely to come into contact with ferrite is decomposed, there is an increase in the number of retained austenite grains which are likely to come into contact with three or more ferrite grains having different crystal orientations, which results in the desired microstructure not being achieved.

Holding in Temperature Range Equal to or Higher than $Ac_1$ Transformation Temperature and Equal to or Lower than ($Ac_1$ Transformation Temperature+150° C.) for 20 s to 1800 s The requirement that holding be performed in a temperature range equal to or higher than the $Ac_1$ transformation temperature and equal to or lower than ($Ac_1$ transformation temperature+150° C.) for 20 s to 1800 s is a significantly important feature in the disclosed embodiments. In the case where holding is performed in a temperature range lower than the $Ac_1$ transformation temperature or for less than 20 s, since carbides which are formed when heating is performed are left undissolved, it is difficult to achieve sufficient area fractions of martensite and retained austenite, which results in a deterioration in strength. In addition, in the case where holding is performed in a temperature range higher than ($Ac_1$ transformation temperature+150° C.), since the effect of Mn concentration in austenite becomes saturated, it is not possible to achieve a sufficient area fraction of retained austenite, which results in a deterioration in ductility. It is preferable that holding be performed in a temperature range equal to or lower than ($Ac_1$ transformation temperature 100° C.). Moreover, in the case where holding is performed for more than 1800 s, there is an increase in the amount of martensite and higher strength, and it is not possible to achieve a sufficient area fraction of retained austenite for achieving satisfactory ductility, In addition, following cooling to a cooling stop temperature after having performed holding in a temperature range equal to or higher than the $Ac_1$ transformation temperature and equal to or lower than ($Ac_1$ transformation temperature+150° C.) for 20 s to 1800 s, by again performing holding in a temperature range equal to or higher than the $Ac_1$ transformation temperature and equal to or lower than ($Ac_1$ transformation temperature+150° C.) for 20 s to 1800 s, it is possible to achieve good material properties. In the case where holding is performed in a temperature range lower than the $Ac_1$ transformation temperature or for less than 20 S, since it is not possible to achieve sufficient area fractions of martensite and retained austenite, there is a deterioration in ductility. On the other hand, in the case where holding is performed in a temperature range higher than the $Ac_1$ transformation temperature or for more than 1800 s, since there is an excessive increase in the area fraction of martensite, there is a deterioration in ductility. It is preferable that the above-described cooling stop temperature be 200° C. or lower in the case where pickling is performed or 200° C. to 500° C. in the case where pickling is not performed. Here, although there is no particular limitation on the method used for cooling to the above-described cooling stop temperature, air cooling may be performed.

Galvanizing Treatment

In the case where a galvanizing treatment is performed, the steel sheet which has been subjected to an annealing treatment as described above is dipped in a galvanizing bath having a temperature of 440° C. or higher and 500° C. or lower to perform a galvanizing treatment, and a coating weight is then adjusted by using, for example, a gas wiping method. Here, it is preferable that a galvanizing bath containing 0.08% or more and 0.30% or less of Al be used for a galvanizing treatment.

In the case where an alloying treatment is performed on a galvanizing layer, an alloying treatment is performed on the galvanizing layer in a temperature range of 450° C. or higher and 600° C. or lower. In the case where an alloying treatment is performed at a temperature of higher than 600° C., since untransformed austenite transforms into pearlite, it is not possible to achieve the desired area fraction of retained austenite, which may result in a deterioration in ductility, Therefore, in the case where an alloying treatment is performed on a galvanizing layer, it is preferable that an alloying treatment be performed in a temperature range of 450° C. or higher and 600° C. or lower.

Although there is no particular limitation on the other conditions applied for the manufacturing method, it is preferable that the above-described annealing treatment (heating and holding) be performed by using continuous annealing equipment in terms of productivity. In addition, it is preferable that a series of treatments including an annealing treatment, a galvanizing treatment, an alloying treatment on a galvanizing layer be performed by using a CGL (continuous galvanizing line), which is a galvanizing treatment line.

Incidentally, skin pass rolling may be performed on a "high strength steel sheet" and a "high strength galvanized steel sheet" described above for the purpose of correcting a shape, adjusting surface roughness, and so forth. It is preferable that the rolling reduction ratio of skin pass rolling be 0.1% or more and 2.0% or less. In the case where the rolling reduction ratio is lower than 0.1%, there is an insufficient effect, and there is a difficulty in control. Therefore, the preferable lower limit is set to be 0.1%. In addition, in the case where the rolling reduction ratio is higher than 2.0%, there is a marked deterioration in productivity. Therefore, the preferable upper limit is set to be 2.0%. Here, skin pass rolling may be performed online or offline. In addition, skin pass tolling may be performed once to obtain the target rolling reduction ratio, or a skin pass rolling may be divided into several times. In addition, various kinds of coating treatments such as oil coating and resin coating may be performed.

Examples

Steels having chemical compositions given in Table 1 with a balance being Fe and incidental impurities were obtained by steelmaking by using a converter and made into steel slabs by using a continuous casting method. The obtained steel slabs were reheated to a temperature of 1250° C., subjected to hot rolling, optionally subjected to a heat treatment in a temperature range equal to or lower than the $Ac_1$ transformation temperature, subjected to cold rolling, subjected to heating and holding in a temperature range equal to or higher than the $Ac_3$ transformation temperature, cooled, and subjected to annealing in a temperature range equal to or higher than the $Ac_1$ transformation temperature and equal to or lower than ($Ac_1$ transformation temperature+150° C.) to obtain high strength cold rolled steel sheets (CR) under the conditions given in Tables 2 and 3, Moreover, the obtained cold rolled steel sheets were subjected to a galvanizing treatment to obtain galvanized steel sheets (GI) and galvannealed steel sheets (GA), Here, in the case where an annealing treatment in a temperature range equal to or higher than the $Ac_1$ transformation temperature and equal to or lower than ($Ac_1$ transformation temperature+150° C.) was performed twice, cooling to room temperature was performed after the first annealing treatment had been performed, and the second annealing treatment was performed thereafter. The galvanizing bath for galvanized steel sheets (GI) contained Al: 0.19 mass %, and the galvanizing bath for galvannealed steel sheets (GA) contained Al: 0.14 mass %. The galvanizing baths had a temperature of 465° C. The coating weight was 45 g/m$^2$ per side (double-sided coating), and, in the case of GA, the Fe concentration in the coating layer was adjusted to be 9 mass % or more and 12 mass % or less.

The cross-sectional microstructure, tensile properties, and hole expansion formability of obtained steel sheets were investigated, and the results are given in Tables 4, 5, and 6.

Incidentally, the $Ac_3$ transformation temperature and the $Ac_3$ transformation temperature were calculated by using the following equations.

$$Ac_1\text{: transformation temperature (° C.)}=751-16\times(\%\ C)+11\times(\%\ Si)-28\times(Mn)-5.5\times(\%\ Cu)-16\times(\%\ Ni)+13\times(\%\ Cr)+3.4\times(\%\ Mo)$$

$$Ac_3\text{ transformation temperature (° C.)}=910-203\times\sqrt{(\%\ C)}+45\times(\%\ Si)-30\times(\%\ Mn)-20\times(\%\ Cu)-15\times(\%\ Ni)+11\times(\%\ Cr)+32\times(\%\ Mo)+104\times(\%\ V)+400\times(\%\ Ti)+200\times(\%\ Al)$$

Here, each of (% C), (% Si), (% Mn), (% Ni), (% Cu), (% Cr), (% Mo), (% V), (% Ti), and (% Al) denotes the content (mass %) of the corresponding element.

TABLE 1

| Steel Grade | Chemical Composition (mass %) | | | | | | | | | | | | | | | | | | | | | | | $A_{C_1}$ Transformation Temperature (° C.) | $A_{D_3}$ Transformation Temperature (° C.) | Note |
|---|---|---|---|---|---|---|---|---|---|---|---|---|---|---|---|---|---|---|---|---|---|---|---|---|---|---|
| | C | Si | Mn | P | S | N | Al | Ti | Nb | V | W | B | Ni | Cr | Mo | Cu | Sn | Sb | Ta | Ca | Mg | Zr | REM | | | |
| A | 0.163 | 0.55 | 3.56 | 0.021 | 0.0022 | 0.0034 | 0.031 | 0.048 | — | — | — | — | — | — | — | — | — | — | — | — | — | — | — | 655 | 771 | Example Steel |
| B | 0.182 | 0.82 | 3.24 | 0.025 | 0.0025 | 0.0040 | 0.048 | 0.042 | — | — | — | — | — | — | — | — | — | — | — | — | — | — | — | 666 | 789 | Example Steel |
| C | 0.175 | 1.64 | 3.61 | 0.020 | 0.0019 | 0.0028 | 0.033 | 0.032 | — | — | — | — | — | — | — | — | — | — | — | — | — | — | — | 667 | 819 | Example Steel |
| D | 0.235 | 0.99 | 3.32 | 0.020 | 0.0029 | 0.0044 | 0.041 | — | — | — | — | — | — | — | — | — | — | — | — | — | — | — | — | 665 | 765 | Example Steel |
| E | 0.034 | 0.77 | 4.11 | 0.022 | 0.0024 | 0.0041 | 0.032 | — | — | — | — | — | — | — | — | — | — | — | — | — | — | — | — | 644 | 790 | Example Steel |
| F | 0.181 | 2.89 | 3.99 | 0.025 | 0.0019 | 0.0021 | 0.040 | 0.043 | — | — | — | — | — | — | — | — | — | — | — | — | — | — | — | 668 | 842 | Example Steel |
| G | 0.199 | 0.59 | 3.54 | 0.024 | 0.0020 | 0.0025 | 0.040 | 0.050 | — | — | — | — | — | — | — | — | — | — | — | — | — | — | — | 655 | 748 | Example Steel |
| H | 0.062 | 1.01 | 5.10 | 0.028 | 0.0027 | 0.0026 | 0.035 | — | — | — | — | — | — | — | — | — | — | — | — | — | — | — | — | 618 | 751 | Example Steel |
| I | 0.185 | 1.49 | 3.77 | 0.023 | 0.0022 | 0.0026 | 0.034 | — | — | — | — | — | — | — | — | — | — | — | — | — | — | — | — | 659 | 783 | Example Steel |
| J | 0.160 | 0.20 | 3.49 | 0.031 | 0.0023 | 0.0035 | 0.031 | 0.046 | — | — | — | — | — | — | — | — | — | — | — | — | — | — | — | 653 | 739 | Example Steel |
| K | 0.127 | 0.37 | 5.81 | 0.027 | 0.0026 | 0.0031 | 0.030 | 0.052 | — | — | — | — | — | — | — | — | — | — | — | — | — | — | — | 590 | 686 | Example Steel |
| L | 0.192 | 0.45 | 3.19 | 0.022 | 0.0026 | 0.0025 | 0.034 | — | — | — | — | — | — | — | — | — | — | — | — | — | — | — | — | 664 | 752 | Example Steel |
| M | 0.151 | 0.61 | 4.16 | 0.022 | 0.0025 | 0.0037 | 0.036 | — | — | — | — | — | — | — | — | — | — | — | — | — | — | — | — | 639 | 741 | Example Steel |
| N | 0.170 | 0.53 | 3.20 | 0.030 | 0.0020 | 0.0032 | 0.038 | 0.040 | — | — | — | — | — | — | — | — | — | — | — | — | — | — | — | 665 | 762 | Example Steel |
| O | 0.206 | 0.33 | 3.62 | 0.026 | 0.0026 | 0.0042 | 0.223 | 0.032 | — | — | — | — | — | — | — | — | — | — | — | — | — | — | — | 650 | 781 | Example Steel |
| P | 0.201 | 4.08 | 3.48 | 0.028 | 0.0027 | 0.0035 | 0.031 | — | — | — | — | — | — | — | — | — | — | — | — | — | — | — | — | 695 | 904 | Comparative Steel |
| Q | 0.181 | 0.63 | 8.13 | 0.026 | 0.0023 | 0.0027 | 0.034 | — | — | — | — | — | — | — | — | — | — | — | — | — | — | — | — | 527 | 615 | Comparative Steel |
| R | 0.171 | 0.60 | 3.88 | 0.019 | 0.0019 | 0.0040 | 0.042 | 0.389 | — | — | — | — | — | — | — | — | — | — | — | — | — | — | — | 646 | 900 | Comparative Steel |
| S | 0.179 | 0.80 | 3.49 | 0.029 | 0.0025 | 0.0040 | 0.045 | 0.013 | 0.043 | — | — | — | — | — | — | — | — | — | — | — | — | — | — | 659 | 770 | Example Steel |

TABLE 1-continued

| Steel Grade | Chemical Composition (mass %) | | | | | | | | | | | | | | | | | | | | | | | $A_{C_1}$ Transformation Temperature (° C.) | $A_{D_3}$ Transformation Temperature (° C.) | Note |
|---|---|---|---|---|---|---|---|---|---|---|---|---|---|---|---|---|---|---|---|---|---|---|---|---|---|---|
| | C | Si | Mn | P | S | N | Al | Ti | Nb | V | W | B | Ni | Cr | Mo | Cu | Sn | Sb | Ta | Ca | Mg | Zr | REM | | | |
| T | 0.198 | 1.14 | 3.59 | 0.031 | 0.0024 | 0.0027 | 0.045 | — | — | 0.59 | — | — | — | — | — | — | — | — | — | — | — | — | — | 660 | 778 | Example Steel |
| U | 0.111 | 1.21 | 4.07 | 0.027 | 0.0025 | 0.0045 | 0.044 | — | — | — | 0.018 | — | — | — | — | — | — | — | — | — | — | — | — | 649 | 783 | Example Steel |
| V | 0.138 | 0.30 | 4.07 | 0.031 | 0.0022 | 0.0044 | 0.040 | 0.019 | — | — | — | 0.0019 | — | — | — | — | — | — | — | — | — | — | — | 638 | 741 | Example Steel |
| W | 0.198 | 0.67 | 3.94 | 0.026 | 0.0023 | 0.0040 | 0.032 | 0.066 | — | — | — | — | 0.301 | — | — | — | — | — | — | — | — | — | — | 640 | 760 | Example Steel |
| X | 0.094 | 0.50 | 3.37 | 0.020 | 0.0019 | 0.0037 | 0.041 | 0.062 | — | — | — | — | — | 0.031 | — | — | — | — | — | — | — | — | — | 661 | 778 | Example Steel |
| Y | 0.099 | 1.40 | 3.08 | 0.029 | 0.0023 | 0.0032 | 0.032 | 0.024 | — | — | — | — | — | — | 0.062 | — | — | — | — | — | — | — | — | 679 | 834 | Example Steel |
| Z | 0.107 | 0.52 | 3.58 | 0.025 | 0.0023 | 0.0027 | 0.040 | — | — | — | — | — | — | — | — | 0.273 | — | — | — | — | — | — | — | 655 | 762 | Example Steel |
| AA | 0.116 | 0.54 | 3.17 | 0.025 | 0.0021 | 0.0033 | 0.035 | 0.035 | — | — | — | — | — | — | — | — | 0.005 | — | — | — | — | — | — | 666 | 790 | Example Steel |
| AB | 0.159 | 0.44 | 3.20 | 0.020 | 0.0025 | 0.0026 | 0.0034 | 0.059 | — | — | — | — | — | — | — | — | — | 0.009 | — | — | — | — | — | 664 | 795 | Example Steel |
| AC | 0.193 | 0.68 | 3.57 | 0.016 | 0.0026 | 0.0030 | 0.033 | — | — | — | — | — | — | — | — | — | — | — | 0.006 | — | — | — | — | 655 | 751 | Example Steel |
| AD | 0.201 | 0.39 | 3.22 | 0.031 | 0.0023 | 0.0026 | 0.041 | — | 0.038 | — | — | — | — | — | — | — | 0.006 | — | — | — | — | — | — | 662 | 748 | Example Steel |
| AE | 0.212 | 0.26 | 3.71 | 0.023 | 0.0027 | 0.0040 | 0.032 | — | 0.032 | — | — | — | — | — | — | — | — | — | 0.007 | — | — | — | — | 647 | 723 | Example Steel |
| AF | 0.210 | 0.95 | 3.97 | 0.024 | 0.0025 | 0.0040 | 0.040 | — | — | — | — | — | — | — | — | — | — | — | — | 0.0031 | — | — | — | 647 | 749 | Example Steel |
| AG | 0.194 | 1.25 | 3.83 | 0.022 | 0.0024 | 0.0036 | 0.035 | — | — | — | — | — | — | — | — | — | — | — | — | — | 0.0020 | — | — | 654 | 769 | Example Steel |
| AH | 0.240 | 0.02 | 3.11 | 0.026 | 0.0023 | 0.0028 | 0.040 | 0.011 | — | — | — | — | — | — | — | — | — | — | — | — | — | 0.0030 | — | 666 | 730 | Example Steel |
| AI | 0.081 | 0.04 | 4.11 | 0.021 | 0.0028 | 0.0036 | 0.048 | — | — | — | — | — | — | — | — | — | — | — | — | — | — | — | 0.0029 | 635 | 740 | Example Steel |

Underlined portion: out of the range of the present invention.

"—" denotes a content of a level of an incidental impurtiy.

TABLE 2

| | | Finish Rolling | | Hot Rolled Steel Sheet Heat Treatment | | | Cold-rolled-sheet Annealing Treatment | | | | Cold-rolled-sheet Annealing Treatment | | Cold-rolled-sheet Annealing Treatment | | | | |
|---|---|---|---|---|---|---|---|---|---|---|---|---|---|---|---|---|---|
| | | Delivery | Coiling | Heat | | Cold | Heat | | Cooling | Cooling Stop | | | | | Alloying | | |
| No. | Steel Grade | Temperature (° C.) | Temperature (° C.) | Treatment Temperature (° C.) | Heat Treatment Time(s) | Rolling Reduction Ratio (%) | Treatment Temperature (° C.) | Heat Treatment Time(s) | Stop Temperature (° C.) | Temperature-Holding Time(s) | Heat Treatment Temperature (° C.) | Heat Treatment Time(s) | Heat Treatment Temperature (° C.) | Heat Treatment Time(s) | Temperature (° C.) | Kind* | Note |
| 1 | A | 890 | 500 | 560 | 18000 | 61.1 | 850 | 150 | 350 | 180 | 690 | 210 | | | | CR | Example |
| 2 | A | 880 | 450 | 510 | 36000 | 52.9 | 820 | 180 | 180 | 250 | 680 | 150 | 700 | 180 | | GI | Example |
| 3 | A | 860 | 480 | 590 | 23400 | 56.3 | 800 | 120 | 150 | 130 | 690 | 180 | 680 | 150 | | GI | Example |
| 4 | A | 900 | 460 | 550 | 28800 | 64.7 | 825 | 150 | 120 | 180 | 700 | 120 | 720 | 300 | 550 | GA | Example |
| 5 | A | 880 | 460 | 520 | 9000 | 57.1 | 850 | 120 | 160 | 130 | 690 | 180 | 690 | 150 | 530 | GA | Example |
| 6 | A | 890 | 450 | 530 | 32400 | 58.8 | 800 | 300 | 200 | 360 | 710 | 360 | | | | CR | Example |
| 7 | A | 910 | 500 | 540 | 36000 | 66.7 | 830 | 140 | 280 | 500 | 720 | 300 | 700 | 210 | | GI | Example |
| 8 | A | 870 | 500 | 540 | 10800 | 66.7 | 830 | 140 | 140 | 510 | 685 | 200 | 720 | 240 | | GI | Example |
| 9 | A | 880 | 550 | 570 | 18000 | 53.3 | 850 | 150 | 140 | 500 | 700 | 210 | 730 | 160 | 500 | GA | Example |
| 10 | A | 900 | 530 | 500 | 7200 | 58.8 | 870 | 180 | 300 | 240 | 710 | 180 | 710 | 140 | 560 | GA | Example |
| 11 | A | 910 | 520 | 600 | 23400 | 62.5 | 610 | 150 | 200 | 180 | 685 | 240 | 680 | 120 | | GI | Comparative Example |
| 12 | A | 920 | 500 | 570 | 14400 | 58.8 | 880 | 120 | 450 | 140 | 680 | 330 | 690 | 130 | 520 | GA | Comparative Example |
| 13 | A | 870 | 540 | 530 | 18000 | 57.1 | 850 | 200 | 20 | 260 | 730 | 190 | 720 | 120 | 500 | GA | Comparative Example |
| 14 | A | 875 | 480 | 530 | 9000 | 61.1 | 800 | 360 | 220 | 900 | 705 | 210 | | | | CR | Comparative Example |
| 15 | A | 880 | 510 | | | 46.2 | 830 | 250 | 170 | 500 | 685 | 180 | 690 | 140 | 540 | GA | Example |
| 16 | B | 890 | 500 | 550 | 21600 | 54.8 | 840 | 360 | 180 | 540 | 690 | 120 | 680 | 150 | | GI | Example |
| 17 | C | 900 | 520 | 570 | 21600 | 52.9 | 850 | 150 | 250 | 180 | 690 | 210 | 705 | 175 | 550 | GA | Example |
| 18 | A | 710 | 540 | 570 | 18000 | 47.1 | 860 | 180 | 140 | 255 | 730 | 250 | 740 | 250 | 530 | GA | Comparative Example |
| 19 | A | 910 | 850 | 590 | 36000 | 56.5 | 870 | 210 | 180 | 260 | 660 | 150 | 670 | 180 | 510 | GA | Comparative Example |
| 20 | A | 880 | 600 | 720 | 21600 | 58.8 | 880 | 180 | 110 | 250 | 700 | 140 | 700 | 150 | 490 | GA | Comparative Example |
| 21 | A | 890 | 590 | 530 | 14400 | 52.9 | 840 | 140 | 100 | 180 | 580 | 190 | 680 | 230 | | GI | Comparative Example |

TABLE 2-continued

| | | Finish Rolling | | Hot Rolled Steel Sheet Heat Treatment | | | Cold-rolled-sheet Annealing Treatment | | | | Cold-rolled-sheet Annealing Treatment | | Cold-rolled-sheet Annealing Treatment | | Alloying | | |
|---|---|---|---|---|---|---|---|---|---|---|---|---|---|---|---|---|---|
| | | Delivery | Coiling | Heat | | Cold | Heat | | Cooling | Cooling Stop | | | | | | | |
| No. | Steel Grade | Temp-erature (° C.) | Temp-erature (° C.) | Treatment Temperature (° C.) | Heat Treatment Time(s) | Rolling Reduction Ratio (%) | Treatment Temperature (° C.) | Heat Treatment Time(s) | Stop Temperature (° C.) | Temperature-Holding Time(s) | Heat Treatment Temperature (° C.) | Heat Treatment Time(s) | Heat Treatment Temperature (° C.) | Heat Treatment Time(s) | Temp-erature (° C.) | Kind* | Note |
| 22 | A | 880 | 580 | | | 52.9 | 860 | 130 | 170 | 175 | 810 | 240 | 680 | 150 | | GI | Comparative Example |
| 23 | A | 880 | 530 | 520 | 23400 | 57.1 | 830 | 120 | 170 | 40 | 740 | 15 | | | | CR | Comparative Example |
| 24 | A | 880 | 560 | 600 | 36000 | 51.7 | 800 | 360 | 100 | 530 | 700 | 2400 | 710 | 350 | | GI | Comparative Example |
| 25 | A | 860 | 560 | 600 | 10800 | 58.8 | 805 | 300 | 120 | 370 | 705 | 120 | 550 | 300 | 500 | GA | Comparative Example |
| 26 | A | 870 | 540 | 540 | 18000 | 68.4 | 800 | 360 | 180 | 625 | 710 | 180 | 860 | 460 | 490 | GA | Comparative Example |
| 27 | A | 850 | 480 | 520 | 7200 | 61.1 | 810 | 150 | 150 | 170 | 680 | 60 | 680 | 10 | 520 | GA | Comparative Example |
| 28 | A | 860 | 580 | 550 | 23400 | 64.7 | 820 | 180 | 110 | 260 | 710 | 150 | 710 | 3600 | 540 | GA | Comparative Example |
| 29 | D | 900 | 560 | 580 | 14400 | 58.8 | 880 | 210 | 170 | 270 | 680 | 170 | | | | CR | Examle |
| 30 | E | 870 | 550 | 570 | 18000 | 58.8 | 900 | 360 | 160 | 530 | 690 | 180 | 680 | 150 | | GI | Example |
| 31 | F | 905 | 600 | 580 | 32400 | 57.1 | 810 | 150 | 180 | 255 | 690 | 120 | | | | CR | Example |
| 32 | F | 890 | 600 | 570 | 32400 | 57.1 | 800 | 120 | 100 | 130 | 680 | 70 | 700 | 240 | 560 | GA | Example |
| 33 | G | 875 | 500 | 525 | 18000 | 53.3 | 820 | 120 | 150 | 150 | 690 | 180 | 680 | 90 | 510 | GA | Example |

underlined portion: out of the range of the present invention

CR: cold rolled steel sheet (without a coating layer). GI: galvanized steel sheet (without an alloying treatment on a galvanizing layer). GA: galvannealed steel sheet

TABLE 3

| | | Finish Rolling | | Hot Rolled Steel Sheet Heat Treatment | | | Cold-rolled-sheet Annealing Treatment | | | | Cold-rolled-sheet Annealing Treatment | | Cold-rolled-sheet Annealing Treatment | | | | |
|---|---|---|---|---|---|---|---|---|---|---|---|---|---|---|---|---|---|
| | | Delivery | Coiling | Heat | | Cold | Heat | | Cooling | Cooling Stop | | | | | Alloying | | |
| No. | Steel Grade | Temperature (° C.) | Temperature (° C.) | Treatment Temperature (° C.) | Heat Treatment Time(s) | Rolling Reduction Ratio (%) | Treatment Temperature (° C.) | Heat Treatment Time(s) | Stop Temperature (° C.) | Temperature-Holding Time(s) | Heat Treatment Temperature (° C.) | Heat Treatment Time(s) | Heat Treatment Temperature (° C.) | Heat Treatment Time(s) | Temperature (° C.) | Kind* | Note |
| 34 | H | 910 | 560 | 530 | 23400 | 50.0 | 780 | 150 | 150 | 150 | 680 | 210 | 700 | 360 | 530 | GA | Example |
| 35 | I | 880 | 500 | 510 | 28800 | 52.9 | 800 | 180 | 130 | 190 | 710 | 180 | | | | CR | Example |
| 36 | J | 870 | 560 | 520 | 32400 | 48.6 | 790 | 900 | 140 | 120 | 690 | 80 | 740 | 120 | | GI | Example |
| 37 | K | 910 | 580 | 560 | 23400 | 46.2 | 780 | 180 | 170 | 290 | 630 | 130 | 640 | 200 | | GI | Example |
| 38 | L | 880 | 610 | 580 | 36000 | 62.5 | 810 | 150 | 130 | 190 | 680 | 190 | 710 | 250 | 550 | GA | Example |
| 39 | L | 880 | 600 | 530 | 28800 | 62.5 | 800 | 140 | 130 | 180 | 690 | 180 | | | | CR | Example |
| 40 | M | 880 | 520 | 520 | 10800 | 58.8 | 820 | 75 | 200 | 120 | 670 | 170 | 660 | 300 | 500 | GA | Example |
| 41 | N | 860 | 480 | | | 52.0 | 825 | 120 | 150 | 140 | 590 | 140 | 590 | 360 | 520 | GA | Example |
| 42 | O | 870 | 560 | 600 | 7200 | 56.3 | 830 | 300 | 190 | 400 | 700 | 80 | | | | CR | Example |
| 43 | P | 890 | 600 | 550 | 7200 | 62.5 | 820 | 150 | 130 | 190 | 680 | 190 | 710 | 250 | 550 | GA | Comparative Example |
| 44 | P | 880 | 600 | 540 | 10800 | 62.5 | 830 | 160 | 150 | 180 | 690 | 180 | | | | CR | Comparative Example |
| 45 | Q | 850 | 480 | 510 | 10800 | 64.7 | 810 | 60 | 130 | 190 | 700 | 90 | 700 | 300 | | GI | Comparative Example |
| 46 | R | 860 | 600 | 560 | 28800 | 50.0 | 810 | 330 | 250 | 500 | 680 | 110 | | | | CR | Comparative Example |
| 47 | S | 900 | 550 | 510 | 36000 | 46.2 | 850 | 150 | 190 | 190 | 690 | 160 | 720 | 600 | 520 | CA | Example |
| 48 | T | 870 | 550 | 570 | 14400 | 52.9 | 850 | 140 | 150 | 170 | 700 | 90 | | | | CR | Example |
| 49 | U | 905 | 560 | | | 47.1 | 840 | 300 | 170 | 420 | 710 | 210 | 700 | 180 | 510 | GA | Example |
| 50 | V | 890 | 610 | 530 | 28800 | 55.6 | 830 | 180 | 140 | 260 | 690 | 90 | 680 | 300 | 520 | GA | Example |
| 51 | W | 910 | 540 | 530 | 18000 | 56.3 | 820 | 180 | 300 | 270 | 680 | 100 | 725 | 200 | | GI | Example |
| 52 | X | 870 | 520 | 520 | 23400 | 58.8 | 800 | 120 | 160 | 160 | 690 | 230 | 700 | 250 | | GI | Example |
| 53 | Y | 880 | 500 | 520 | 23400 | 64.7 | 850 | 120 | 140 | 140 | 710 | 140 | 700 | 270 | | GI | Example |
| 54 | Z | 900 | 500 | 570 | 9000 | 62.5 | 850 | 150 | 320 | 200 | 700 | 120 | 690 | 250 | 500 | GA | Example |
| 55 | AA | 910 | 580 | 510 | 28800 | 56.3 | 860 | 160 | 200 | 210 | 710 | 200 | 740 | 300 | 510 | GA | Example |
| 56 | AB | 855 | 580 | | | 53.8 | 880 | 140 | 150 | 180 | 710 | 230 | 720 | 340 | 520 | GA | Example |
| 57 | AC | 900 | 560 | 520 | 32400 | 56.3 | 900 | 90 | 100 | 130 | 680 | 70 | 685 | 180 | | GI | Example |
| 58 | AD | 900 | 550 | 540 | 10800 | 56.3 | 850 | 80 | 100 | 125 | 690 | 90 | 680 | 170 | 530 | GA | Example |
| 59 | AE | 850 | 550 | 540 | 10800 | 56.3 | 800 | 120 | 100 | 150 | 680 | 150 | 730 | 160 | | CR | Example |
| 60 | AF | 880 | 520 | 510 | 14400 | 64.7 | 840 | 150 | 170 | 195 | 690 | 120 | 690 | 150 | 480 | GA | Example |
| 61 | AG | 840 | 500 | | | 46.7 | 850 | 180 | 100 | 200 | 680 | 160 | | | | CR | Example |
| 62 | AH | 860 | 490 | 560 | 23400 | 50.0 | 840 | 240 | 170 | 300 | 710 | 200 | 680 | 140 | 540 | GA | Example |
| 63 | AI | 880 | 500 | 580 | 10800 | 57.1 | 820 | 300 | 120 | 180 | 690 | 130 | 680 | 150 | 510 | GA | Example |

underlined portion: out of the range of the present invention

CR: cold rolled steel sheet (without a coating layer). GI: galvanized steel sheet (without an alloying treatment on a galvanizing layer). GA: galvannealed steel sheet

TABLE 4

| No. | Steel Grade | Thick-ness (mm) | (Sum of Area Fractions of RA and M Having a Circle-equivalent Grain size of 3 μm or more)/ (Sum of Area Fractions of All Ra and M) | (Area fraction of RA Adjacent to Three or more F Grains)/ (Area raction of All RA) | Average Mn Content in RA (mass %) | Average Mn Content in F (mass %) | (Average Mn Content in RA)/ (Average Mn Content in F) |
|---|---|---|---|---|---|---|---|
| 1 | A | 1.4 | 0.151 | 0.427 | 5.85 | 1.21 | 4.83 |
| 2 | A | 1.6 | 0.112 | 0.504 | 6.19 | 1.93 | 3.21 |
| 3 | A | 1.4 | 0.127 | 0.382 | 5.65 | 1.88 | 3.01 |
| 4 | A | 1.2 | 0.260 | 0.488 | 5.88 | 1.94 | 3.03 |
| 5 | A | 1.2 | 0.131 | 0.354 | 5.86 | 1.96 | 2.99 |
| 6 | A | 1.4 | 0.071 | 0.546 | 4.67 | 2.72 | 1.72 |
| 7 | A | 1.2 | 0.294 | 0.521 | 4.55 | 3.00 | 1.52 |
| 8 | A | 1.0 | 0.195 | 0.576 | 4.82 | 2.96 | 1.63 |
| 9 | A | 1.4 | 0.291 | 0.440 | 4.94 | 3.01 | 1.64 |
| 10 | A | 1.4 | 0.192 | 0.524 | 5.00 | 3.03 | 1.65 |
| 11 | A | 1.2 | 0.201 | 0.783 | 4.91 | 2.08 | 2.36 |
| 12 | A | 1.4 | 0.137 | 0.771 | 4.32 | 2.01 | 2.15 |
| 13 | A | 1.2 | 0.307 | 0.702 | 4.24 | 1.41 | 3.01 |
| 14 | A | 1.4 | 0.186 | 0.700 | 4.15 | 2.21 | 1.88 |
| 15 | A | 1.4 | 0.371 | 0.486 | 5.32 | 2.25 | 2.36 |
| 16 | B | 1.4 | 0.153 | 0.527 | 5.23 | 2.08 | 2.51 |
| 17 | C | 1.6 | 0.292 | 0.424 | 5.65 | 1.48 | 3.81 |
| 18 | A | 1.8 | 0.133 | 0.646 | 4.94 | 2.68 | 1.84 |
| 19 | A | 1.0 | 0.358 | 0.531 | 3.95 | 2.56 | 1.54 |
| 20 | A | 1.4 | 0.399 | 0.574 | 4.56 | 2.52 | 1.81 |
| 21 | A | 1.6 | 0.327 | 0.417 | 4.01 | 3.14 | 1.28 |
| 22 | A | 1.6 | 0.328 | 0.491 | 3.56 | 2.87 | 1.34 |
| 23 | A | 1.2 | 0.064 | 0.442 | 3.99 | 3.20 | 1.25 |
| 24 | A | 1.4 | 0.134 | 0.527 | 3.86 | 3.20 | 1.21 |
| 25 | A | 1.4 | 0.398 | 0.414 | 3.74 | 3.10 | 1.21 |
| 26 | A | 1.2 | 0.348 | 0.450 | 3.89 | 2.84 | 1.37 |
| 27 | A | 1.4 | 0.170 | 0.475 | 3.90 | 2.80 | 1.39 |
| 28 | A | 1.2 | 0.215 | 0.470 | 3.99 | 2.15 | 1.86 |
| 29 | D | 1.4 | 0.252 | 0.571 | 4.67 | 2.97 | 2.26 |
| 30 | E | 1.4 | 0.244 | 0.550 | 6.37 | 2.80 | 2.27 |
| 31 | F | 1.2 | 0.297 | 0.440 | 6.40 | 2.78 | 2.30 |
| 32 | F | 1.2 | 0.292 | 0.485 | 6.38 | 2.85 | 2.24 |
| 33 | G | 1.4 | 0.291 | 0.494 | 5.11 | 2.32 | 2.20 |
| 34 | H | 1.4 | 0.113 | 0.478 | 9.99 | 3.01 | 3.32 |
| 35 | I | 1.6 | 0.142 | 0.519 | 5.60 | 2.71 | 2.07 |
| 36 | J | 1.8 | 0.095 | 0.443 | 4.95 | 1.96 | 2.52 |
| 37 | K | 1.4 | 0.248 | 0.532 | 10.09 | 3.45 | 2.92 |
| 38 | L | 1.2 | 0.244 | 0.450 | 5.40 | 2.62 | 2.06 |
| 39 | L | 1.2 | 0.296 | 0.517 | 5.19 | 2.46 | 2.11 |
| 40 | M | 1.4 | 0.245 | 0.451 | 6.96 | 2.22 | 3.13 |
| 41 | N | 1.2 | 0.385 | 0.462 | 5.30 | 2.19 | 2.42 |
| 42 | O | 1.4 | 0.130 | 0.562 | 5.44 | 2.61 | 2.08 |
| 43 | P | 1.2 | 0.376 | 0.500 | 5.22 | 2.62 | 1.99 |
| 44 | P | 1.2 | 0.299 | 5.17 | 5.35 | 2.46 | 2.18 |
| 45 | Q | 1.2 | 0.252 | 0.431 | 14.21 | 3.03 | 4.69 |
| 46 | R | 1.4 | 0.100 | 0.443 | 5.12 | 2.85 | 1.80 |
| 47 | S | 1.4 | 0.175 | 0.508 | 5.14 | 3.00 | 1.71 |
| 48 | T | 1.6 | 0.265 | 0.468 | 5.51 | 2.63 | 2.10 |
| 49 | U | 18 | 0.360 | 0.573 | 5.55 | 3.02 | 1.84 |
| 50 | V | 1.6 | 0.256 | 0.640 | 5.66 | 2.83 | 2.15 |
| 51 | W | 1.4 | 0.244 | 0.444 | 4.55 | 2.84 | 1.60 |
| 52 | X | 1.4 | 0.133 | 0.515 | 5.40 | 2.30 | 2.35 |
| 53 | Y | 1.2 | 0.291 | 0.500 | 5.93 | 2.28 | 2.60 |
| 54 | Z | 1.2 | 0.111 | 0.570 | 5.92 | 2.72 | 2.18 |
| 55 | AA | 1.4 | 0.100 | 0.459 | 5.61 | 2.50 | 2.24 |
| 56 | AB | 1.2 | 0.365 | 0.579 | 5.87 | 2.61 | 2.25 |
| 57 | AC | 1.4 | 0.250 | 0.494 | 5.92 | 2.92 | 2.03 |
| 58 | AD | 1.4 | 0.289 | 0.472 | 5.58 | 2.62 | 2.13 |
| 59 | AW | 1.4 | 0.285 | 0.443 | 5.58 | 2.70 | 2.07 |
| 60 | AF | 1.2 | 0.073 | 0.504 | 5.26 | 2.83 | 1.86 |
| 61 | AG | 1.6 | 0.354 | 0.559 | 5.46 | 2.56 | 2.13 |
| 62 | AH | 1.4 | 0.099 | 0.579 | 5.74 | 2.83 | 2.03 |
| 63 | AI | 1.2 | 0.289 | 0.537 | 5.69 | 2.89 | 1.97 |

underlined portion: out of the range of the present incention

F: fernite, M: as-quenched martensile, RA: retained austenite

TABLE 5

| No. | Area Fraction of F (%) | Area Fraction of M (%) | Area Fraction of TM (%) | Area Fraction of RA (%) | Average size of F (um) | Average size of RA (u) | Area Fraction of Massive RA (%) | Area Fraction of Lath-structured RA (%) | (Area Fraction of Massive RA)/((Area Fraction of Massice RA) + (AreaFraction of Lath-structured RA)) | Remaining Microstructure |
|---|---|---|---|---|---|---|---|---|---|---|
| 1 | 55.5 | 19.7 | 0.4 | 20.4 | 5.6 | 1.9 | 9.4 | 11.0 | 0.46 | B, P, θ |
| 2 | 53.4 | 21.1 | 1.9 | 19.1 | 5.0 | 1.0 | 9.3 | 9.8 | 0.49 | B, P, θ |
| 3 | 54.4 | 22.0 | 0.7 | 22.3 | 5.1 | 1.6 | 8.5 | 13.8 | 0.38 | B, P, θ |
| 4 | 52.6 | 19.3 | 2.9 | 23.2 | 5.2 | 2.3 | 10.1 | 13.1 | 0.44 | B, P, θ |
| 5 | 53.7 | 18.0 | 2.9 | 23.4 | 5.7 | 1.6 | 9.3 | 14.1 | 0.40 | B, P, θ |
| 6 | 45.1 | 34.6 | 1.7 | 14.8 | 5.3 | 1.0 | 7.5 | 7.3 | 0.51 | B, P, θ |
| 7 | 45.6 | 34.2 | 2.3 | 16.4 | 5.5 | 2.4 | 7.7 | 8.7 | 0.47 | B, P, θ |
| 8 | 44.4 | 34.9 | 2.6 | 15.2 | 4.9 | 2.7 | 7.4 | 7.8 | 0.49 | B, P, θ |
| 9 | 46.0 | 34.8 | 1.8 | 15.3 | 5.7 | 0.7 | 7.0 | 8.3 | 0.46 | B, P, θ |
| 10 | 45.9 | 34.1 | 0.6 | 15.9 | 5.1 | 2.6 | 8.8 | 7.1 | 0.55 | B, P, θ |
| 11 | 48.2 | 25.0 | 2.5 | 20.9 | 5.2 | 2.5 | 18.1 | 2.8 | 0.87 | B, P, θ |
| 12 | 54.1 | 21.7 | 0.6 | 19.8 | 5.1 | 1.4 | 15.5 | 4.3 | 0.78 | B, P, θ |
| 13 | 54.9 | 22.9 | 0.8 | 21.2 | 5.2 | 2.1 | 14.3 | 6.9 | 0.67 | B, P, θ |
| 14 | 50.9 | 20.3 | 1.1 | 22.2 | 5.0 | 2.8 | 15.1 | 7.1 | 0.68 | B, P, θ |
| 15 | 51.8 | 18.4 | 2.2 | 24.8 | 5.1 | 1.7 | 7.0 | 17.8 | 0.28 | B, P, θ |
| 16 | 56.7 | 17.5 | 1.8 | 21.0 | 5.7 | 0.6 | 6.6 | 14.4 | 0.31 | B, P, θ |
| 17 | 59.6 | 12.3 | 0.8 | 25.1 | 5.3 | 0.9 | 12.6 | 12.5 | 0.50 | B, P, θ |
| 18 | 48.1 | 34.0 | 2.6 | 14.4 | 7.1 | 0.7 | 6.4 | 8.0 | 0.44 | B, P, θ |
| 19 | 57.9 | 15.4 | 1.0 | 21.8 | 9.5 | 2.1 | 10.0 | 11.8 | 0.46 | B, P, θ |
| 20 | 52.4 | 21.2 | 2.8 | 20.5 | 5.3 | 2.2 | 17.1 | 3.4 | 0.83 | B, P, θ |
| 21 | 64.3 | 3.2 | 1.7 | 6.6 | 4.9 | 2.5 | 5.4 | 1.2 | 0.82 | B, P, θ |
| 22 | 78.5 | 10.2 | 0.2 | 5.5 | 6.0 | 0.9 | 4.4 | 1.1 | 0.80 | B, P, θ |
| 23 | 72.7 | 4.3 | 2.1 | 6.0 | 5.6 | 1.8 | 5.5 | 0.5 | 0.92 | B, P, θ |
| 24 | 45.5 | 38.9 | 0.1 | 5.2 | 5.3 | 1.0 | 5.1 | 0.1 | 0.98 | B, P, θ |
| 25 | 78.8 | 3.2 | 1.0 | 6.6 | 5.5 | 1.7 | 4.0 | 2.6 | 0.61 | B, P, θ |
| 26 | 46.7 | 36.4 | 2.7 | 13.2 | 5.0 | 1.8 | 6.8 | 6.4 | 0.52 | B, P, θ |
| 27 | 75.5 | 3.5 | 2.7 | 7.1 | 5.2 | 2.8 | 7.1 | 0.0 | 1.00 | B, P, θ |
| 28 | 50.0 | 35.6 | 1.2 | 9.3 | 6.0 | 0.6 | 8.1 | 1.2 | 0.87 | B, P, θ |
| 29 | 50.2 | 18.7 | 1.1 | 25.8 | 4.9 | 2.3 | 4.9 | 20.9 | 0.19 | B, P, θ |
| 30 | 49.4 | 22.1 | 2.2 | 18.1 | 5.1 | 1.7 | 9.0 | 9.1 | 0.50 | B, P, θ |
| 31 | 47.8 | 20.3 | 0.9 | 24.9 | 5.4 | 0.8 | 7.2 | 17.7 | 0.29 | B, P, θ |
| 32 | 51.0 | 21.1 | 2.6 | 19.1 | 5.2 | 2.7 | 9.4 | 9.7 | 0.49 | B, P, θ |
| 33 | 49.7 | 19.4 | 1.5 | 25.0 | 4.8 | 1.9 | 12.3 | 12.7 | 0.49 | B, P, θ |
| 34 | 55.4 | 20.4 | 0.6 | 19.6 | 5.3 | 1.8 | 9.8 | 9.8 | 0.50 | B, P, θ |
| 35 | 50.3 | 18.8 | 1.2 | 25.9 | 5.0 | 1.9 | 11.1 | 14.8 | 0.43 | B, P, θ |
| 36 | 43.1 | 34.4 | 2.1 | 15.1 | 5.5 | 1.6 | 7.5 | 7.6 | 0.50 | B, P, θ |
| 37 | 51.8 | 14.5 | 1.8 | 27.1 | 5.6 | 0.5 | 10.4 | 16.7 | 0.38 | B, P, θ |
| 38 | 53.3 | 14.5 | 0.5 | 25.9 | 5.7 | 0.8 | 12.6 | 13.3 | 0.49 | B, P, θ |
| 39 | 50.0 | 15.2 | 2.1 | 26.4 | 6.0 | 2.1 | 13.1 | 13.3 | 0.50 | B, P, θ |
| 40 | 52.4 | 16.6 | 0.5 | 26.0 | 5.4 | 0.7 | 12.1 | 13.9 | 0.47 | B, P, θ |
| 41 | 56.9 | 18.9 | 2.7 | 20.6 | 5.8 | 1.5 | 9.9 | 10.7 | 0.48 | B, P, θ |
| 42 | 52.6 | 19.9 | 1.8 | 20.0 | 5.3 | 1.8 | 8.3 | 11.7 | 0.42 | B, P, θ |
| 43 | 57.4 | 15.8 | 0.6 | 24.4 | 5.7 | 0.8 | 12.6 | 11.8 | 0.52 | B, P, θ |
| 44 | 50.2 | 22.1 | 2.2 | 23.4 | 6.0 | 2.1 | 13.1 | 10.3 | 0.56 | B, P, θ |
| 45 | 49.3 | 13.3 | 2.3 | 29.3 | 5.3 | 1.8 | 14.5 | 14.8 | 0.49 | B, P, θ |
| 46 | 50.2 | 36.3 | 0.1 | 12.1 | 5.5 | 0.8 | 12.0 | 0.1 | 0.99 | B, P, θ |
| 47 | 54.3 | 17.5 | 2.8 | 22.9 | 5.2 | 2.3 | 9.2 | 13.7 | 0.40 | B, P, θ |
| 48 | 53.1 | 17.6 | 2.5 | 22.8 | 5.7 | 1.4 | 9.3 | 13.5 | 0.41 | B, P, θ |
| 49 | 52.7 | 21.6 | 2.8 | 21.2 | 5.5 | 1.2 | 6.3 | 14.9 | 0.30 | B, P, θ |
| 50 | 50.1 | 21.8 | 1.6 | 23.6 | 5.7 | 0.8 | 7.4 | 16.2 | 0.31 | B, P, θ |
| 51 | 48.1 | 34.3 | 1.3 | 15.8 | 5.0 | 2.7 | 8.6 | 7.2 | 0.54 | B, P, θ |
| 52 | 50.2 | 20.0 | 1.8 | 20.4 | 5.5 | 1.5 | 8.8 | 11.6 | 0.43 | B, P, θ |
| 53 | 50.4 | 20.4 | 2.6 | 20.1 | 5.3 | 1.5 | 9.9 | 10.2 | 0.49 | B, P, θ |
| 54 | 51.0 | 20.1 | 2.8 | 20.8 | 5.7 | 0.5 | 8.2 | 12.6 | 0.39 | B, P, θ |
| 55 | 53.4 | 19.7 | 1.3 | 20.2 | 5.0 | 0.9 | 9.0 | 11.2 | 0.45 | B, P, θ |
| 56 | 52.0 | 20.1 | 0.7 | 21.0 | 5.3 | 1.1 | 9.7 | 11.3 | 0.46 | B, P, θ |
| 57 | 51.5 | 20.4 | 0.4 | 21.0 | 5.5 | 1.5 | 10.1 | 10.9 | 0.48 | B, P, θ |
| 58 | 50.9 | 20.0 | 2.2 | 22.6 | 5.4 | 1.8 | 9.6 | 13.0 | 0.42 | B, P, θ |
| 59 | 51.0 | 20.2 | 0.5 | 23.2 | 6.8 | 1.4 | 11.1 | 12.1 | 0.48 | B, P, θ |
| 60 | 53.7 | 18.7 | 2.4 | 20.4 | 6.0 | 1.2 | 9.2 | 11.2 | 0.45 | B, P, θ |
| 61 | 52.2 | 22.2 | 0.1 | 21.3 | 5.5 | 2.4 | 10.0 | 11.3 | 0.47 | B, P, θ |
| 62 | 50.3 | 19.5 | 1.7 | 20.4 | 5.1 | 1.3 | 9.9 | 10.5 | 0.49 | B, P, θ |
| 63 | 51.2 | 23.7 | 1.9 | 20.1 | 5.0 | 2.3 | 9.4 | 10.7 | 0.47 | B, P, θ |

underlined portion: out of the range of the present invention

F: fernite, M: as-quenched martensile, TM: tempered martensile. RA: retained austenite, B: bainite, P: pearlite, θ: carbide (such as cementile)

| No. | TS (MPa) | EL (%) | TS × EL (MPa %) | λ (Blanking) (%) | λ (Reaming) (%) | R (mm) | R/I | Phosphatability | Coatablity | Note |
|---|---|---|---|---|---|---|---|---|---|---|
| 1 | 993 | 22.4 | 22243 | 23 | 53 | 3.4 | 2.4 | 5 | | Example |
| 2 | 1016 | 24.8 | 25246 | 21 | 45 | 3.6 | 2.3 | | ○ | Example |
| 3 | 1006 | 25.8 | 26006 | 22 | 55 | 3.2 | 2.3 | | ○ | Example |
| 4 | 1020 | 24.5 | 24990 | 18 | 49 | 2.4 | 2.0 | 5 | ○ | Eample |
| 5 | 1025 | 27.0 | 27675 | 26 | 56 | 2.6 | 2.2 | | ○ | Example |
| 6 | 1161 | 14.0 | 16534 | 15 | 35 | 3.2 | 2.3 | 5 | | Example |
| 7 | 1201 | 13.7 | 16454 | 18 | 33 | 2.6 | 2.2 | | ○ | Example |
| 8 | 1230 | 14.8 | 18204 | 19 | 40 | 2.4 | 2.4 | | ○ | Example |
| 9 | 1197 | 13.6 | 16279 | 22 | 43 | 3.4 | 2.4 | | ○ | Example |
| 10 | 1198 | 15.0 | 17970 | 21 | 41 | 3.5 | 2.5 | | ○ | Example |
| 11 | 1050 | 22.0 | 23100 | 14 | 45 | 3.8 | 3.2 | | ○ | Comparative Example |
| 12 | 982 | 23.9 | 23470 | 14 | 46 | 3.8 | 2.7 | | ○ | Comparative Example |
| 13 | 1091 | 21.1 | 23020 | 5 | 47 | 4.0 | 3.3 | | ○ | Comparative Example |
| 14 | 1052 | 22.3 | 23460 | 13 | 40 | 4.2 | 3.0 | 5 | | Comparative Example |
| 15 | 1030 | 26.5 | 27295 | 25 | 51 | 2.8 | 2.0 | | ○ | Example |
| 16 | 1015 | 25.5 | 25883 | 19 | 60 | 2.8 | 2.0 | | ○ | Example |
| 17 | 1001 | 24.9 | 24925 | 20 | 46 | 3.5 | 2.2 | | ○ | Example |
| 18 | 1195 | 10.8 | 12906 | 16 | 42 | 3.4 | 1.9 | | ○ | Comparative Example |
| 19 | 944 | 29.6 | 27942 | 27 | 58 | 1.0 | 1.0 | | ○ | Comparative Example |
| 20 | 1000 | 23.6 | 23800 | 15 | 42 | 4.5 | 2.5 | | ○ | Example |
| 21 | 903 | 25.4 | 22936 | 29 | 43 | 2.0 | 1.3 | | ○ | Comparative Example |
| 22 | 1020 | 18.7 | 19074 | 35 | 60 | 3.4 | 2.1 | | ○ | Comparative Example |
| 23 | 978 | 19.6 | 19169 | 15 | 61 | 2.6 | 2.2 | 5 | | Comparative Example |
| 24 | 1209 | 11.3 | 13662 | 10 | 51 | 3.4 | 2.4 | | ○ | Comparative Example |
| 25 | 860 | 18.6 | 15996 | 33 | 48 | 1.4 | 1.0 | | ○ | Comparative Example |
| 26 | 1121 | 13.9 | 15582 | 13 | 46 | 2.8 | 2.3 | | ○ | Comparative Example |
| 27 | 802 | 18.4 | 14757 | 40 | 59 | 0.8 | 0.6 | | ○ | Comparative Example |
| 28 | 1090 | 15.1 | 16459 | 10 | 52 | 3.5 | 2.5 | | ○ | Comparative Example |
| 29 | 1071 | 26.4 | 28274 | 24 | 62 | 2.8 | 2.0 | 4 | | Example |
| 30 | 980 | 21.0 | 20582 | 20 | 41 | 3.4 | 2.4 | | ○ | Example |
| 31 | 1049 | 23.2 | 24337 | 21 | 42 | 2.5 | 2.1 | 4 | | Example |
| 32 | 1000 | 24.0 | 24000 | 20 | 40 | 2.4 | 2.0 | | Δ | Example |
| 33 | 1053 | 27.8 | 29273 | 26 | 47 | 3.2 | 2.3 | | ○ | Example |
| 34 | 996 | 21.5 | 21414 | 20 | 55 | 3.2 | 2.3 | | ○ | Example |
| 35 | 1023 | 23.2 | 23734 | 20 | 47 | 3.4 | 2.1 | 4 | | Example |
| 36 | 1185 | 15.2 | 18012 | 22 | 36 | 3.8 | 2.1 | | ○ | Example |
| 37 | 993 | 29.0 | 28797 | 27 | 53 | 2.5 | 1.8 | | ○ | Example |
| 38 | 987 | 22.2 | 21911 | 21 | 43 | 3.0 | 2.5 | | ○ | Example |
| 39 | 1001 | 22.4 | 22422 | 20 | 45 | 2.8 | 2.3 | 4 | | Example |
| 40 | 1022 | 26.0 | 26572 | 18 | 46 | 2.6 | 1.9 | | ○ | Example |
| 41 | 1030 | 23.1 | 23793 | 23 | 45 | 2.6 | 2.2 | | ○ | Example |
| 42 | 999 | 23.0 | 22977 | 20 | 46 | 2.6 | 2.0 | 4 | | Example |
| 43 | 987 | 21.6 | 21319 | 21 | 52 | 2.8 | 2.3 | | x | Comparative Example |
| 44 | 1084 | 19.9 | 21572 | 18 | 50 | 2.4 | 2.0 | 2 | | Comparative Example |
| 45 | 984 | 30.9 | 30406 | 21 | 43 | 2.8 | 2.3 | | x | Comparative Example |
| 46 | 1092 | 21.0 | 22932 | 10 | 48 | 3.2 | 2.3 | 4 | | Comparative Example |
| 47 | 993 | 21.4 | 21250 | 24 | 54 | 2.8 | 2.0 | | ○ | Example |
| 48 | 994 | 24.9 | 24751 | 23 | 60 | 4.0 | 2.5 | 4 | | Example |
| 49 | 1034 | 24.3 | 25126 | 22 | 58 | 4.2 | 2.3 | | ○ | Example |
| 50 | 1099 | 22.3 | 24508 | 20 | 44 | 3.0 | 1.9 | | ○ | Example |
| 51 | 1214 | 15.0 | 18210 | 16 | 38 | 2.6 | 1.9 | | ○ | Example |
| 52 | 999 | 26.9 | 26873 | 22 | 52 | 3.0 | 2.1 | | ○ | Example |
| 53 | 984 | 23.1 | 22730 | 23 | 53 | 2.6 | 2.2 | | ○ | Example |
| 54 | 1020 | 21.3 | 21726 | 20 | 51 | 2.4 | 2.0 | | ○ | Example |
| 55 | 995 | 24.0 | 23880 | 22 | 53 | 3.0 | 2.1 | | ○ | Example |
| 56 | 983 | 21.1 | 20741 | 24 | 45 | 2.4 | 2.0 | | ○ | Example |
| 57 | 984 | 22.0 | 21646 | 23 | 49 | 3.0 | 2.1 | | ○ | Example |
| 58 | 1037 | 20.2 | 20947 | 21 | 42 | 3.2 | 2.3 | | ○ | Example |
| 59 | 1000 | 22.8 | 22800 | 23 | 53 | 3.2 | 2.3 | 4 | | Example |
| 60 | 1012 | 22.8 | 23074 | 22 | 51 | 2.5 | 2.1 | | ○ | Example |
| 61 | 1080 | 17.8 | 19224 | 19 | 42 | 3.8 | 2.4 | 4 | | Example |
| 62 | 982 | 25.1 | 24648 | 25 | 50 | 2.8 | 2.0 | | ○ | Example |
| 63 | 1062 | 23.0 | 24426 | 21 | 50 | 2.5 | 2.1 | | ○ | Example |

underlined portion: out of the range of the present invention

A tensile test was performed on a JIS No. 5 test specimen which had been taken as a sample so that the tensile direction was a direction perpendicular to the rolling direction of the steel sheet in accordance with JIS Z 2241 (2011) to determine TS (tensile strength) and EL (total elongation).

In the disclosed embodiments, the following cases in mechanical properties are judged as good.

EL: 20% or more in the case of TS: 980 MPa or more and less than 1080 MPa

EL: 16% or more in the case of TS: 1080 MPa or more and less than 1180 MPa

EL: 12% or more in the case of TS: 1180 MPa or more and less than 1270 MPa

Here, the thickness was 1.0 mm to 1.8 mm.

A hole expanding test was performed in accordance with JIS Z 2256 (2010). Each of the obtained steel sheet was cut into a piece having a size of 100 mm×100 mm, a hole having a diameter of 10 mm was made in the cut piece by using a blanking method with a clearance of 12%±18 or a reaming method, and the hole was expanded by pushing a conical punch having a point angle of 60° into the hole while the cut piece was held with a blank holding force of 9 tons on a die having an inner diameter of 75 mm to determine the diameter of the expanded hole for a crack generation limit, the limiting hole expanding ratio λ (8) was calculated by using the equation below, and hole expansion formability was evaluated on the basis of the limiting hole expanding ratio.

Here, the term "reaming" denotes a process in which a drilled hole is enlarged by using the cutting edges of a reamer so that the hole has a predetermined diameter, and the cut surface is then finished by using the margin of the reamer so that the cut surface is smoothened.

$$\text{limiting hole expanding ratio } \lambda\ (\%)=\{(D_f-D_0)/D_0\}\times 100$$

Here, $D_f$ denotes the diameter (mm) of the hole when a crack is generated, and Do denotes the initial diameter (mm) of the hole. Here, in the disclosed embodiments, the following cases are judged as good depending on TS.

(blanking) λ: 15% or more or (reaming) λ: 40% or more in the case of TS: 980 MPa or more and less than 1080 MPa (blanking) λ: 12% or more or (reaming) λ: 35% or more in the case of TS: 1080 MPa or more and less than 1180 MPa (blanking) λ: 10% or more or (reaming) λ: 30% or more in the case of TS: 1180 MPa or more and less than 1270 MPa A bending test was performed on a bending test specimen having a width of 30 mm and a length of 100 mm which had been taken from each of the annealed steel sheets so that the rolling direction was the bending direction in accordance with the V-block method prescribed in JIS Z 2248 (1996). The test was performed with a pushing speed of 100 mm/s three times each for respective one of the bending radii, the outer side of the bending position was observed by using a stereoscopic microscope to judge whether or not a crack was generated, and the limiting bending radius R (mm) was defined as the minimum bending radius with which no crack was generated. Here, in the disclosed embodiments, a case where (limiting bending radius R)/t (t: steel sheet thickness (mm)) was 2.5 or less in a 90° V-bend was judged as a case of a steel sheet having good bendability Phosphatability was evaluated by forming a chemical conversion coating film by performing a chemical conversion treatment on each of the obtained cold rolled steel sheet by using the method described below in which a chemical conversion treatment solution produced by Nihon Parkerizing Co., Ltd. (PALBOND L-3080 (registered trademark)) was used.

The obtained cold rolled steel sheet was first degreased by using a degreasing solution FINE CLEANER (registered trademark) produced by Nihon Parkerizing Co., Ltd., washed with water, and then subjected to surface conditioning for 30 s by using a surface conditioning solution PREPALENE-Z (registered trademark) produced by Nihon Parkerizing Co., Ltd. The cold rolled steel sheet which had been subjected to surface conditioning was dipped in a chemical conversion treatment solution (PALBOND L-3080 (registered trademark)) having a temperature of 43° C. for 120 s, washed with water, and dried with hot air. In such a way a chemical conversion treatment was performed on the cold rolled steel sheet.

The surface of the cold rolled steel sheet which had been subjected to a chemical conversion treatment was observed by using a SEM (scanning electron microscope) at a magnification of 500 times in randomly selected 5 fields of view. The area fraction (%) of a region in which a chemical conversion film was not formed (so called lack of hiding) was determined by performing image analysis, and evaluation was performed on the basis the obtained area fraction in accordance with the following evaluation criteria.

grade 5: 5% or less
grade 4: more than 5% and 10% or less
grade 3: more than 10% and 25% or less
grade 2: more than 25% and 40% or less
grade 1: more than 40%

A case of grade 4 or grade 5 is regarded as a case of good phosphatability. In particular, grade 5 is preferable, Coatability was evaluated by performing visual test. A case where an appropriate surface quality is achieved without any poor appearance such as a coating defect, a variation in alloying degree, and other defects causing deterioration in surface quality was judged as "○", a case of an excellent appearance without a variation in color tone or the like was judged as "⊙", a case where a partial minor defect was found was judged as "Δ", and a case where many surface defects were found was judged as "x"

All of the high strength steel sheets of the examples of the disclosed embodiments had a TS of 980 MPa or more and excellent formability. On the other hand, the comparative examples were poor in terms of at least one of TS, EL, A, bendability, phosphatability, and coatability.

INDUSTRIAL APPLICABILITY

According to the disclosed embodiments, it is possible to obtain a high strength steel sheet having a TS (tensile strength) of 980 MPa or more and excellent formability, By using the high strength steel sheet according to the disclosed embodiments for, for example, automobile structural members, it is possible to improve fuel efficiency due to a decrease in the weight of an automobile body, which has a significant utility value in the industry.

The invention claimed is:

1. A high strength steel sheet having a chemical composition comprising, by mass %:

C: 0.030% to 0.250%;
Si: 0.01% to 3.00%;
Mn: 3.20% to 8.00%;
P: 0.001% to 0.100%;
S: 0.0001% to 0.0200%;
N: 0.0005% to 0.0100%;
Al: 0.001% to 2.000%; and
a balance being Fe and incidental impurities, wherein the steel sheet has a microstructure including, in terms of area fraction, in a range of 35% or more and 80% or less of ferrite, in a range of 5% or more and 35% or less of as-quenched martensite, in a range of 0.1% or more and less than 3.0% of tempered martensite, and 8% or more of retained austenite, an average grain size of the ferrite is 6 μm or less, an average grain size of the retained austenite is 3 μm or less, a value calculated by dividing an average Mn content, by mass %, in the retained austenite by an average Mn content, by mass %, in the ferrite is 1.5 or more, a value calculated by dividing a sum of an area fraction of as-quenched martensite having a circle-equivalent grain size of 3 μm or more and an area fraction of retained austenite having a circle-equivalent grain size of 3 μm or more by a sum of an area fraction of all the as-quenched martensite and an area fraction of all the retained austenite is less than 0.4, and a value calculated by dividing an area fraction of retained austenite grains adjacent to three or more ferrite grains having different crystal orientations by the area fraction of all the retained austenite is less than 0.6.

2. The high strength steel sheet according to claim 1, wherein the chemical composition further comprises, by mass %, at least one selected from the group consisting of Ti: 0.005% to 0.200%, Nb: 0.005% to 0.200%, V: 0.005% to 0.500%, W: 0.005% to 0.500%, B: 0.0003% to 0.0050%, Ni: 0.005% to 1.000%, Cr: 0.005% to 1.000%, Mo: 0.005% to 1.000%, Cu: 0.005% to 1.000%, Sn: 0.002% to 0.200%, Sb: 0.002% to 0.200%, Ta: 0.001% to 0.100%, Ca: 0.0005% to 0.0050%, Mg: 0.0005% to 0.0050%, Zr: 0.0005% to 0.0050%, and REM: 0.0005% to 0.0050%.

3. The high strength steel sheet according to claim 2, wherein the steel sheet has a galvanizing layer disposed on a surface of the steel sheet.

4. The high strength steel sheet according to claim 3, wherein the galvanizing layer is a galvannealing layer.

5. A method for manufacturing a high strength steel sheet according to claim 2, the method comprising:

heating a steel slab having the chemical composition, performing hot rolling on the heated slab with a finish rolling delivery temperature in a range of 750° C. or higher and 1000° C. or lower, coiling the hot rolled steel sheet at a temperature in a range of 300° C. or higher and 750° C. or lower, performing cold rolling on the hot rolled steel sheet, subsequently holding the cold rolled steel sheet in a temperature range equal to or higher than an $Ac_3$ transformation temperature for a duration in a range of 20 s to 1800 s, and cooling the steel sheet to a cooling stop temperature in a range of 50° C. or higher and 350° C. or lower, holding the cooled steel sheet at the cooling stop temperature for a duration in a range of 2 s to 600 s, cooling the steel sheet, subsequently holding the cooled steel sheet in a temperature range equal to or higher than an $Ac_1$ transformation temperature and equal to or lower than a sum of the $Ac_1$ transformation temperature+150° C. for a duration in a range of 20 s to 1800 s, and cooling the steel sheet.

6. The method for manufacturing a high strength steel sheet according to claim 5, further comprising, after coiling has been performed, holding the steel sheet in a temperature range equal to or lower than the $Ac_1$ transformation temperature for more than 1800 s.

7. The method for manufacturing a high strength steel sheet according to claim 6, further comprising performing a galvanizing treatment.

8. The method for manufacturing a high strength steel sheet according to claim 7, further comprising, after the galvanizing treatment has been performed, performing an alloying treatment at a temperature in a range of 450° C. to 600° C.

9. The method for manufacturing a high strength steel sheet according to claim 5, further comprising performing a galvanizing treatment.

10. The method for manufacturing a high strength steel sheet according to claim 9, further comprising, after the galvanizing treatment has been performed, performing an alloying treatment at a temperature in a range of 450° C. to 600° C.

11. A method for manufacturing a high strength steel sheet according to claim 2, the method comprising:

heating a steel slab having the chemical composition, performing hot rolling on the heated slab with a finish rolling delivery temperature in a range of 750° C. or higher and 1000° C. or lower, coiling the hot rolled steel sheet at a temperature in a range of 300° C. or higher and 750° C. or lower, performing cold rolling on the hot rolled steel sheet, subsequently holding the cold rolled steel sheet in a temperature range equal to or higher than an $Ac_3$ transformation temperature for a duration in a range of 20 s to 1800 s, cooling the steel sheet to a cooling stop temperature in a range of 50° C. or higher and 350° C. or lower, holding the cooled steel sheet at the cooling stop temperature for a duration in a range of 2 s to 600 s, subsequently cooling the steel sheet, holding the cooled steel sheet in a temperature range equal to or higher than an $Ac_1$ transformation temperature and equal to or lower than a sum of the $Ac_1$ transformation temperature+150° C. for a duration in a range of 20 s to 1800 s, cooling the steel sheet, again holding the cooled steel sheet in the temperature range equal to or higher than the $Ac_1$ transformation temperature and equal to or lower than the sum of the $Ac_1$ transformation temperature+150° C. for a duration in a range of 20 s to 1800 s, and cooling the steel sheet.

12. The method for manufacturing a high strength steel sheet according to claim 11, further comprising, after coiling has been performed, holding the steel sheet in a temperature range equal to or lower than the $Ac_1$ transformation temperature for more than 1800 s.

13. The method for manufacturing a high strength steel sheet according to claim 12, further comprising performing a galvanizing treatment.

14. The method for manufacturing a high strength steel sheet according to claim 13, further comprising, after the galvanizing treatment has been performed, performing an alloying treatment at a temperature in a range of 450° C. to 600° C.

15. The method for manufacturing a high strength steel sheet according to claim 11, further comprising performing a galvanizing treatment.

16. The method for manufacturing a high strength steel sheet according to claim 15, further comprising, after the galvanizing treatment has been performed, performing an alloying treatment at a temperature in a range of 450° C. to 600° C.

17. The high strength steel sheet according to claim 1, wherein the steel sheet has a galvanizing layer disposed on a surface of the steel sheet.

18. The high strength steel sheet according to claim 17, wherein the galvanizing layer is a galvannealing layer.

19. A method for manufacturing a high strength steel sheet according to claim 1, the method comprising:

heating a steel slab having the chemical composition, performing hot rolling on the heated slab with a finish rolling delivery temperature in a range of 750° C. or higher and 1000° C. or lower, coiling the hot rolled steel sheet at a temperature in a range of 300° C. or higher and 750° C. or lower, performing cold rolling on the hot rolled steel sheet, subsequently holding the cold rolled steel sheet in a temperature range equal to or higher than an $Ac_3$ transformation temperature for a duration in a range of 20 s to 1800 s, and cooling the steel sheet to a cooling stop temperature in a range of 50° C. or higher and 350° C. or lower, holding the cooled steel sheet at the cooling stop temperature for a duration in a range of 2 s to 600 s, cooling the steel sheet, subsequently holding the cooled steel sheet in a temperature range equal to or higher than an $Ac_1$ transformation temperature and equal to or lower than a sum of the $Ac_1$ transformation temperature+150° C. for a duration in a range of 20 s to 1800 s, and cooling the steel sheet.

20. A method for manufacturing a high strength steel sheet according to claim 1, the method comprising:

heating a steel slab having the chemical composition, performing hot rolling on the heated slab with a finish rolling delivery temperature in a range of 750° C. or higher and 1000° C. or lower, coiling the hot rolled steel sheet at a temperature in a range of 300° C. or higher and 750° C. or lower, performing cold rolling on the hot rolled steel sheet, subsequently holding the cold rolled steel sheet in a temperature range equal to or higher than an $Ac_3$ transformation temperature for a duration in a range of 20 s to 1800 s, cooling the steel sheet to a cooling stop temperature in a range of 50° C. or higher and 350° C. or lower, holding the cooled steel sheet at the cooling stop temperature for a duration in a range of 2 s to 600 s, subsequently cooling the steel sheet, holding the cooled steel sheet in a temperature range equal to or higher than an $Ac_1$ transformation temperature and equal to or lower than a sum of the $Ac_1$ transformation temperature+150° C. for a duration in a range of 20 s to 1800 s, cooling the steel sheet, again holding the cooled steel sheet in the temperature range equal to or higher than the $Ac_1$ transformation temperature and equal to or lower than the sum of the $Ac_1$ transformation temperature+150° C. for a duration in a range of 20 s to 1800 s, and cooling the steel sheet.

* * * * *